US008509630B2

(12) United States Patent
Henderson et al.

(10) Patent No.: US 8,509,630 B2
(45) Date of Patent: Aug. 13, 2013

(54) DETERMINING THE CAUSE OF PRINTER IMAGE ARTIFACTS

(75) Inventors: Thomas Allen Henderson, Rochester, NY (US); Richard George Allen, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 314 days.

(21) Appl. No.: 13/076,472

(22) Filed: Mar. 31, 2011

(65) Prior Publication Data

US 2012/0251141 A1 Oct. 4, 2012

(51) Int. Cl.
*G03G 15/00* (2006.01)

(52) U.S. Cl.
USPC ..... 399/9; 399/49

(58) Field of Classification Search
USPC ..... 399/49, 9, 38; 358/1.1, 504, 406
See application file for complete search history.

(56) References Cited

U.S. PATENT DOCUMENTS

| | | | | |
|---|---|---|---|---|
| 6,608,641 | B1 | 8/2003 | Alexandrovich et al. | 347/131 |
| 7,058,325 | B2 | 6/2006 | Hamby et al. | 399/49 |
| 7,120,379 | B2 | 10/2006 | Eck | 399/267 |
| 7,382,507 | B2 | 6/2008 | Wu | 358/523 |
| 7,400,339 | B2 | 7/2008 | Sampath et al. | 347/251 |
| 7,755,799 | B2 | 7/2010 | Paul et al. | 358/1.9 |
| 2006/0133870 | A1 | 6/2006 | Ng et al. | 399/341 |
| 2008/0118273 | A1 | 5/2008 | Ogata et al. | 399/167 |
| 2008/0226361 | A1 | 9/2008 | Tomita et al. | 399/301 |
| 2009/0002724 | A1 | 1/2009 | Paul | 398/1.1 |
| 2010/0097657 | A1 | 4/2010 | Kuo et al. | 358/3.01 |
| 2011/0235059 | A1 | 9/2011 | Tai et al. | 358/1.1 |
| 2012/0251131 | A1* | 10/2012 | Henderson et al. | 399/9 |

* cited by examiner

*Primary Examiner* — Sophia S Chen
(74) *Attorney, Agent, or Firm* — Kevin E. Spaulding

(57) ABSTRACT

A method is provided of determining the cause of artifacts in images produced by an electrophotographic (EP) printer. A reference image is printed and artifacts in it are detected. After printing normal images, a test image is printed and artifacts in it are detected. If a detected artifact in the test image does not correspond to a detected artifact in the reference image, a characteristic frequency spectrum of the artifact in the test image is determined. Run-out on rotatable imaging components is measured, and a characteristic frequency spectrum of each is determined. The test image spectrum is compared to each component spectrum to identify which component is causing the artifact.

7 Claims, 14 Drawing Sheets

DETERMINING THE CAUSE OF PRINTER IMAGE ARTIFACTS

CROSS-REFERENCE TO RELATED APPLICATIONS

Reference is made to commonly assigned, co-pending U.S. Patent Application Publication No. 2012/0251131 filed concurrently herewith, entitled "Compensating For Periodic Nonuniformity in Electrophotographic Printer" by Thomas A. Henderson, et al., the disclosure of which is incorporated by reference herein.

FIELD OF THE INVENTION

This invention pertains to the field of electrophotographic printing and more particularly to determining the cause of artifacts in images produced by a printer.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g., clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g., of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

Various components used in the electrophotographic process, such as belts and drums, can have mechanical or electrical characteristics that result in periodic objectionable nonuniformities in print images, such as streaks (extending in-track) or bands (extending cross-track). For example, drums can experience runout: they can be elliptical rather than circular in cross-section, or can be mounted slightly off-center, so that the radius of the drum at a particular angle with the horizontal varies over time. Belts can have thicknesses that vary across their widths (cross-track) or along their lengths (in-track). Damped springs for mounting components can experience periodic vibrations, causing the spacing between the mounted components to change over time. These variations can be periodic in nature, that is, each variation cycles through various magnitudes repeatedly in sequence, at a characteristic and generally fixed frequency. The variations can also be non-periodic. For example, two cooperating drums with periodic non-uniformities at frequencies whose ratio is irrational will produce a non-periodic nonuniformity between them.

As a printer operates, its components age at different rates and, eventually, fail at different times. Aging of components can result in degradation of the image quality of prints produced. U.S. Pat. No. 7,400,339 to Sampath et al. describes detecting a banding defect and modifying operation of the printer to compensate. Sampath describes that this scheme extends the operational effectiveness of a printer without requiring downtime for service. Various schemes have been proposed for correcting non-uniformities, including U.S. Pat. No. 7,058,325 to Hamby et al., U.S. Patent Publication No. 2008/0226361 by Tomita et al., and U.S. Pat. No. 7,755,799 to Paul et al., all of which measure printed test patches to evaluate image quality. Similarly to Sampath, U.S. Pat. No. 7,382,507 to Wu describes detecting image quality defects in a print and storing information about the defects at a plurality of times to produce a database of defects. The database contents are analyzed to determine the print engine failure that caused, e.g., a banding defect. However, the scheme of Wu requires reconstructing isolated spectra describing each defect from a simplified description of the defect. This reconstruction can omit significant details of the banding that should be corrected.

Moreover, these schemes use calculations on noisy density data from test patches to detect or compensate for banding artifacts and other non-uniformities. Moreover, multiple components in a printer can have individual non-uniformities of different periods, phases, and amplitudes. These non-uniformities interact with each other, producing significant noise in measured density data and rendering detection more difficult. There is a continuing need, therefore, for an improved method of determining the cause of image artifacts in images produced by an electrophotographic printer.

SUMMARY OF THE INVENTION

The non-uniformities resulting from mechanical variations can be used to evaluate the overall function of a printer. Specifically, when a new nonuniformity develops, or an existing one changes, the responsible component can be determined by measuring the components directly. Service personnel can then determine whether the component or another component in the printer needs to be replaced.

According to an aspect of the present invention, therefore, there is provided a method of determining the cause of artifacts in images produced by an electrophotographic (EP) printer, comprising:

providing the EP printer with:

a print engine for producing an image on a receiving member, the print engine including a plurality of rotatable imaging components;

a plurality of runout sensors for measuring the distance between a respective reference point and the surface of the respective rotatable imaging component along a respective reference axis; and an artifact sensor for detecting one or more artifacts, or the absence of artifacts, in the produced image;

producing a reference image using the print engine, detecting zero or more artifact(s) in the reference image using the artifact sensor, and storing information identifying the detected artifact(s) in a memory;

producing one or more image(s) using the print engine;

producing a test image using the print engine and detecting zero or more artifact(s) in the test image using the artifact sensor;

determining whether at least one of the detected artifacts in the test image does not correspond to one of the zero or more artifact(s) detected in the reference image using the stored information;

if one of the artifact(s) does not correspond:

selecting one of the non-corresponding image artifact(s) in the test image;

determining a characteristic frequency spectrum of the selected image artifact;

rotating at least two of the rotatable imaging components and, while each rotatable imaging component is rotating, measuring the respective distances of the component at a plurality of angles of rotation of the imaging component using the respective runout sensor;

automatically determining a respective characteristic frequency spectrum of each measured imaging component using the corresponding measured distances; and automatically comparing the characteristic frequency spectrum of the selected image artifact in the test image to the respective characteristic frequency spectra of one or more of the measured imaging component(s) to determine which imaging component(s) are causing the image artifact.

According to another aspect of the present invention, there is provided a method of identifying malfunctions in an electrophotographic (EP) printer, comprising:

providing the EP printer with:

a print engine for producing an image on a receiving member, the print engine including a plurality of rotatable imaging components; and a plurality of runout sensors for measuring the distance between a respective reference point and the surface of the respective rotatable imaging component along a respective reference axis;

a first rotating step of rotating the rotatable imaging components and, while each rotated imaging component is rotating, measuring the respective distances at a plurality of angles of rotation of the imaging component as reference distances using the respective runout sensor;

for each measured imaging component, storing the measured reference distances or information identifying the reference distances in a memory;

producing one or more images using the print engine;

a second rotating step of rotating one or more of the rotatable imaging components and, while each rotated imaging component is rotating, measuring the respective distances at a plurality of angles of rotation of the imaging component as test distances using the respective runout sensor; and comparing the stored reference distances to the respective test distances and determining that a component whose test distances do not correspond to the respective reference distances is malfunctioning.

An advantage of this invention is that it permits determining which component is causing image artifacts even in the presence of numerous components with frequencies that beat together to form complex artifact profiles. Various embodiments permit locating the cause even of aperiodic artifacts. This invention provides a rapid, accurate determination of which component is failing. This determination can be performed automatically, e.g., by the printer itself, and the printer can place its own service call. Various embodiments use frequency spectra to compare artifacts in a manner independent of the phase of an artifact with respect to the printed page. This advantageously determines the cause without requiring a dedicated phase sensor.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein:

FIG. 1 is an elevational cross-section of an electrophotographic reproduction apparatus suitable for use with;

The attached drawings are for purposes of illustration and are not necessarily to scale.

DETAILED DESCRIPTION OF THE INVENTION

As used herein, the terms "parallel" and "perpendicular" have a tolerance of ±10°.

The term "variation" refers to a mechanical or electrical non-ideality or characteristic that has a negative effect on the image quality of a printed image, or on the ability of a printer to reproduce a desired aim image or density.

The terms "nonuniformity," "defect," and "artifact" refer to detectable or measurable errors in the reproduction by a printer of a given aim. For example, a banding artifact is a stripe that extends in the cross-track direction and that has a density or densities different than the aim density or densities in the stripe. The term "nonuniformity" refers to the fact that artifacts are generally detected using test targets that would be uniform in density, if not for the artifacts.

Figure 12A:
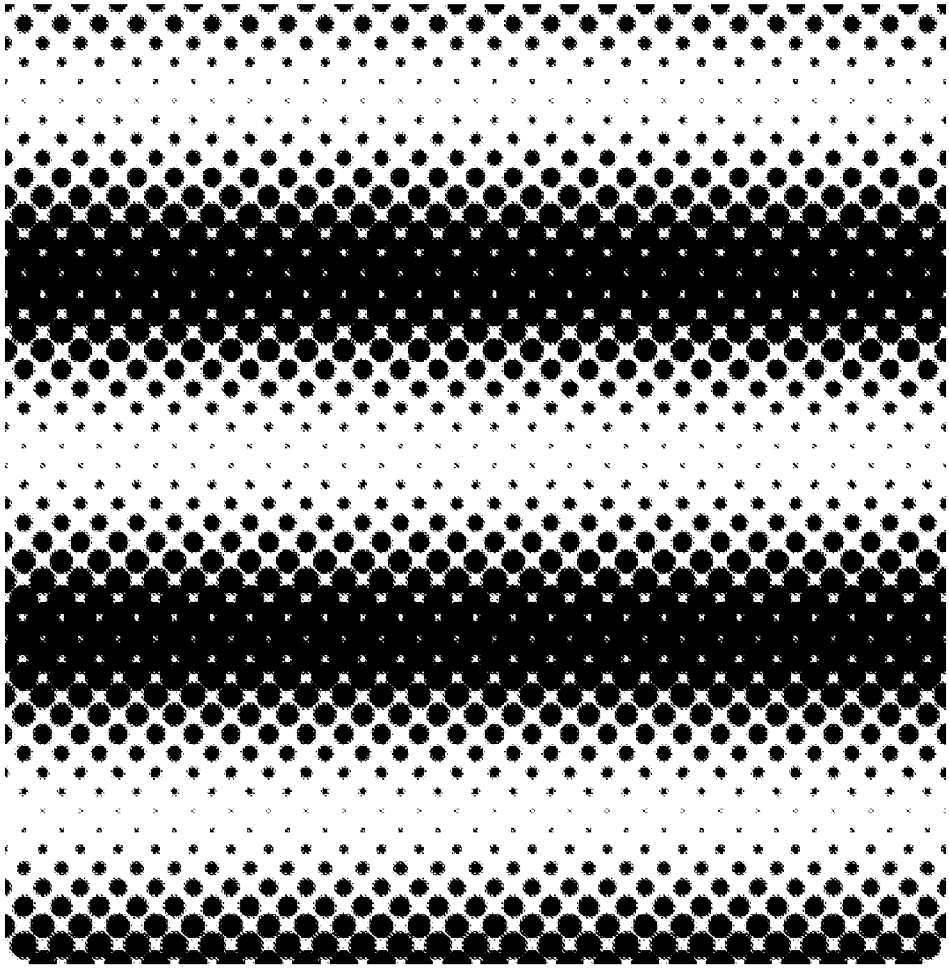
FIGS. 12A and 13A are halftoned representations of simulated image artifacts.
Figure 12B:
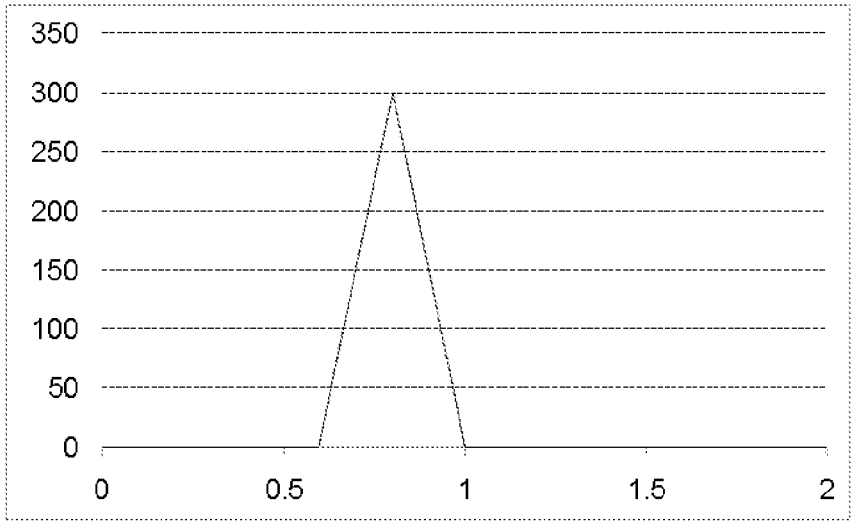
FIGS. 12B and 13B show discrete Fourier transforms of columns of the simulated artifacts represented in FIGS. 12A and 13A.
Figure 13A:
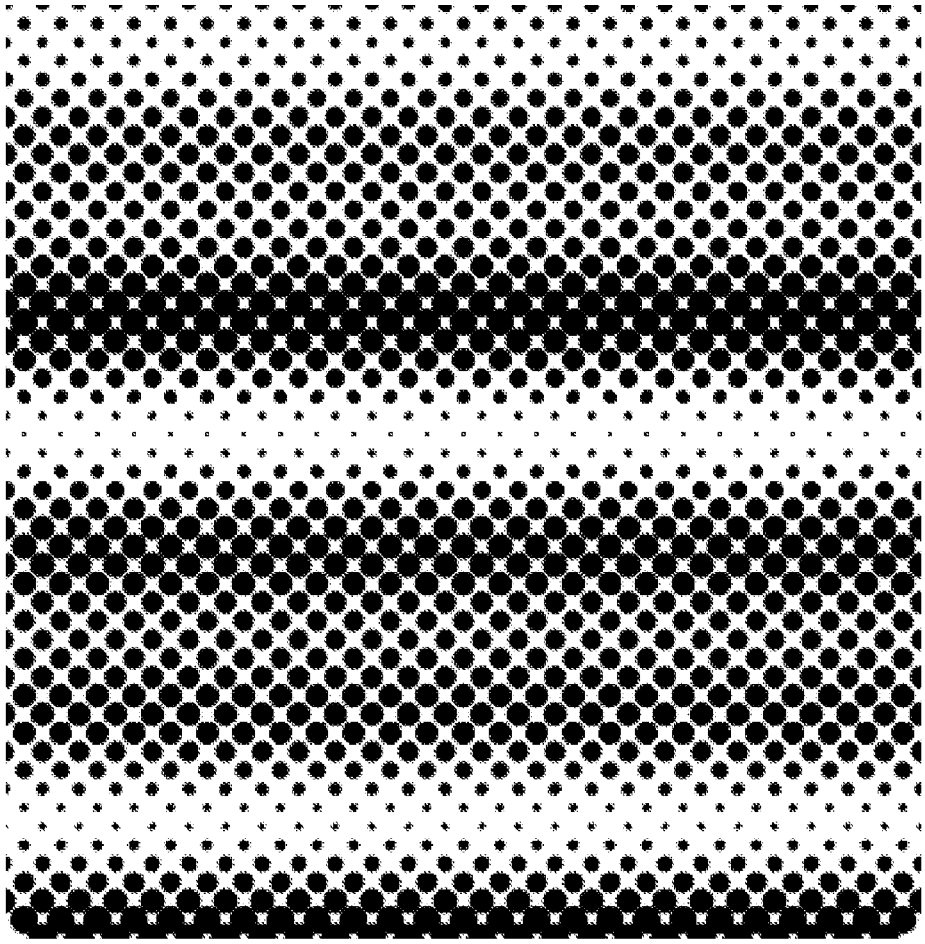
Figure 13B:
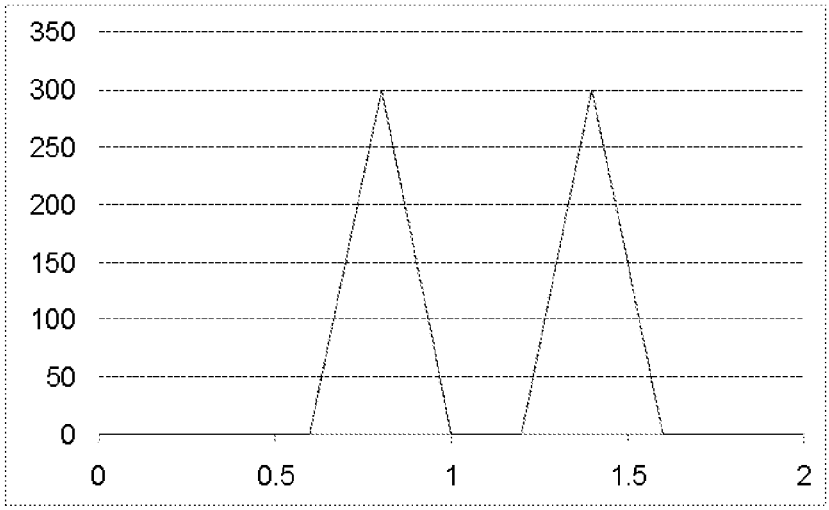

FIGS. 12A and 13A are halftoned representations of simulated image artifacts. FIGS. 12B and 13B show discrete Fourier transforms of columns of those images, with frequency on the abscissa and magnitude on the ordinate.

The image of FIG. 12A has cross-track banding defects with an in-track frequency of 0.8 (arbitrary units). The FFT has a single peak since the simulation is of a pure sinusoid. The FFT peak is triangular due to the sampling rate selected.

The image of FIG. 13A has the banding of FIG. 12A, plus an additional sinusoidal artifact with in-track frequency 1.4 on the same scale of arbitrary units. The FFT in FIG. 13B therefore has two peaks: the original at 0.8 and the new at 1.4.

In the terms of various embodiments described below, FIG. 12A represents a reference image. FIG. 13A represents a test image. That the two images are different indicates that the printer has suffered a degradation in performance between when FIG. 12A was printed and when FIG. 13A was printed. In this example, the degradation can be in an imaging component with a rotational frequency of 0.8. The degradation can indicate the component has become loosened in its mount and has started to vibrate with a frequency of 1.4.

In the following description, some embodiments will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, systems and methods described herein. Other aspects of such algorithms and systems, and hardware or software for producing and otherwise processing the image signals involved therewith, not specifically shown or described herein, are selected from such systems, algorithms, components, and elements known in the art. Given the systems and methods as described herein, software not specifically shown, suggested, or described herein that is useful for implementation of any embodiment is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method(s) according various embodiment(s).

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color onto a receiver. A printer can also produce selected patterns of toner on a receiver, which patterns (e.g., surface textures) do not correspond directly to a visible image. The DFE receives input electronic files (such as Postscript command files) composed of images from other input devices (e.g., a scanner, a digital camera). The DFE can include various function processors, e.g., a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g., the electrophotographic process) to provide known, consistent color reproduction characteristics. The color management system can also provide known color reproduction for different inputs (e.g., digital camera images or film images).

In an embodiment of an electrophotographic modular printing machine useful with various embodiments, e.g., the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g., dyes or pigments, which absorb specific wavelengths of visible light. Commercial machines of this type typically employ intermediate transfer components in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 1:
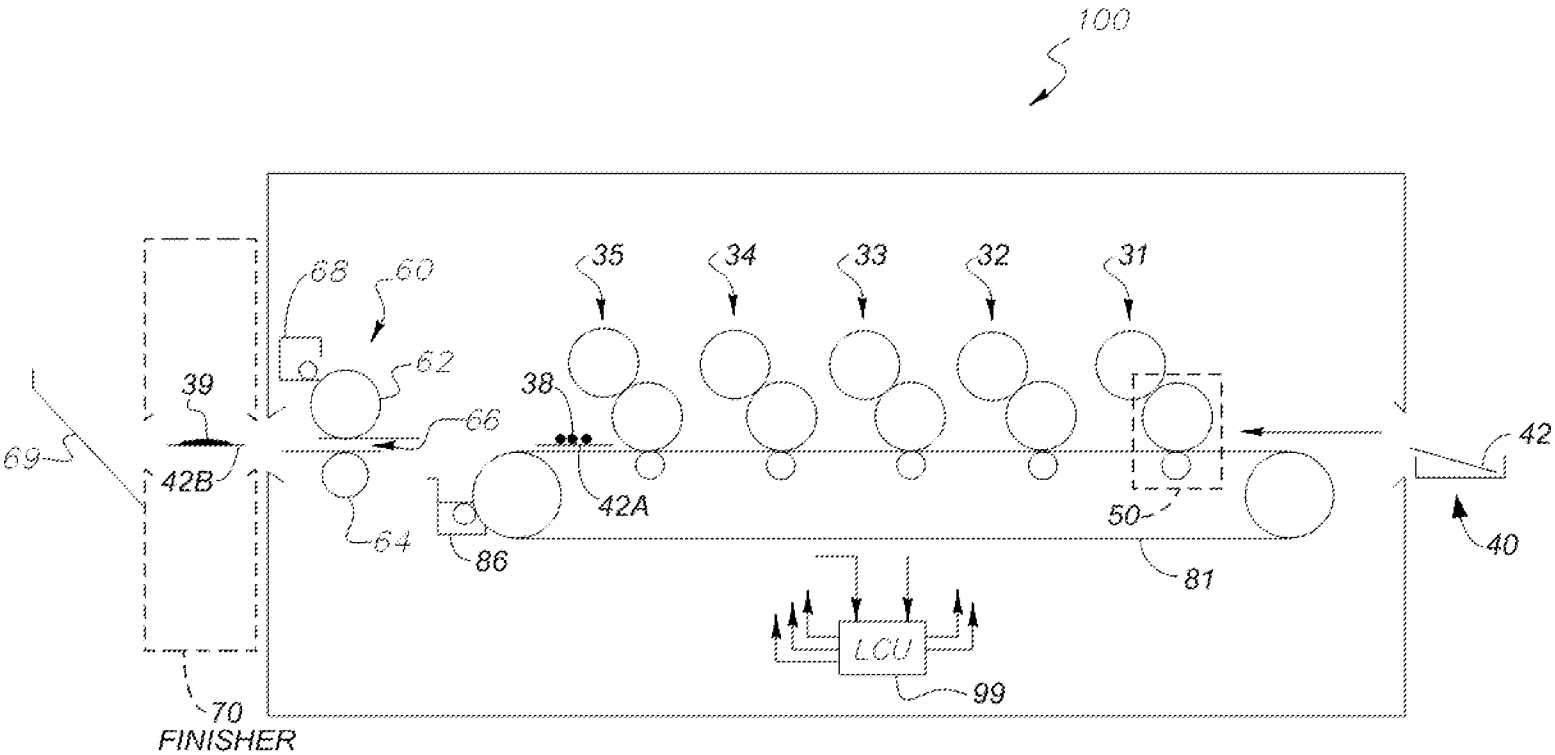
Figure 2:
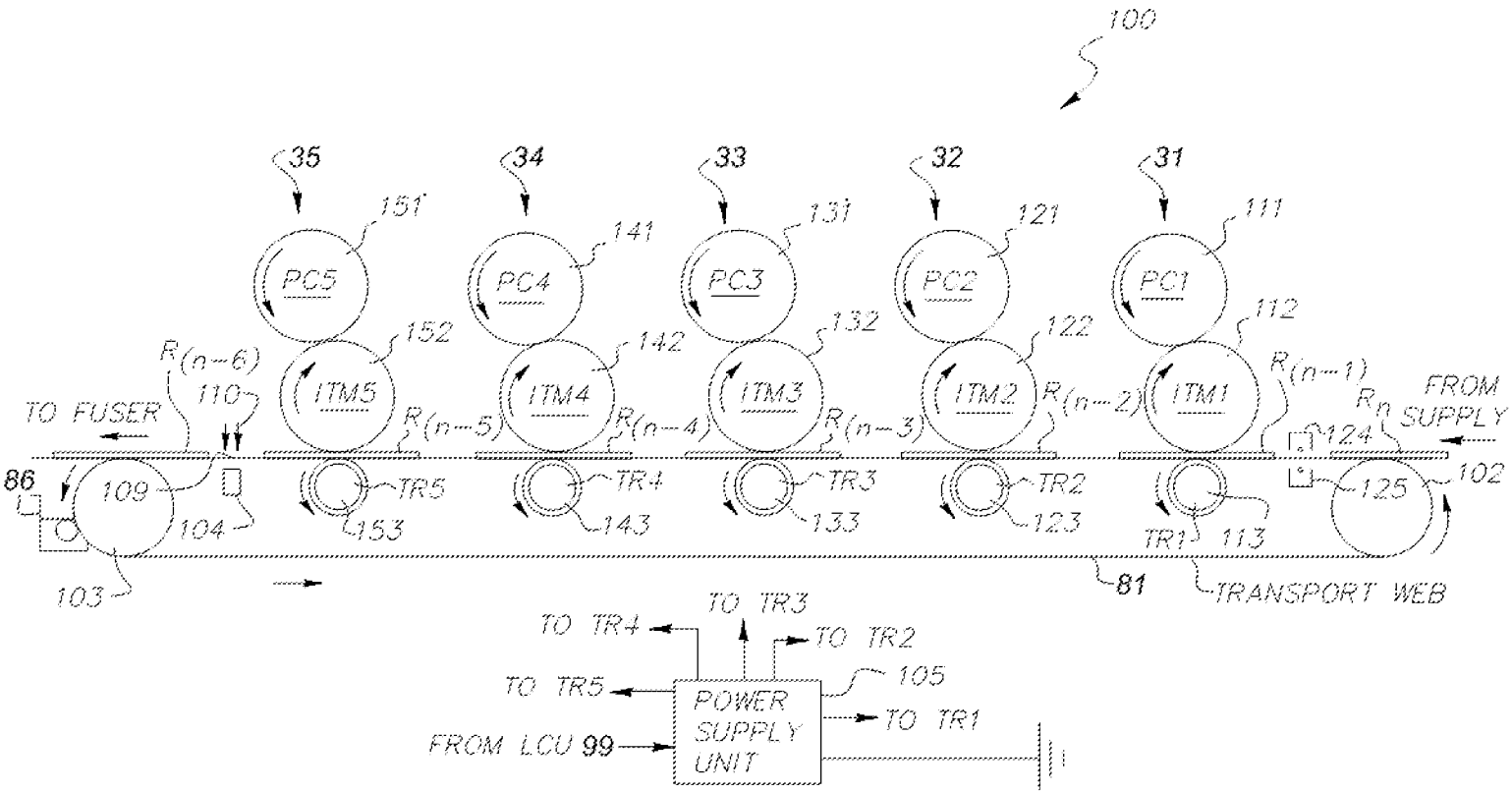
FIG. 2 is an elevational cross-section of the reprographic image-producing portion of the apparatus of FIG. 1.
Figure 3:
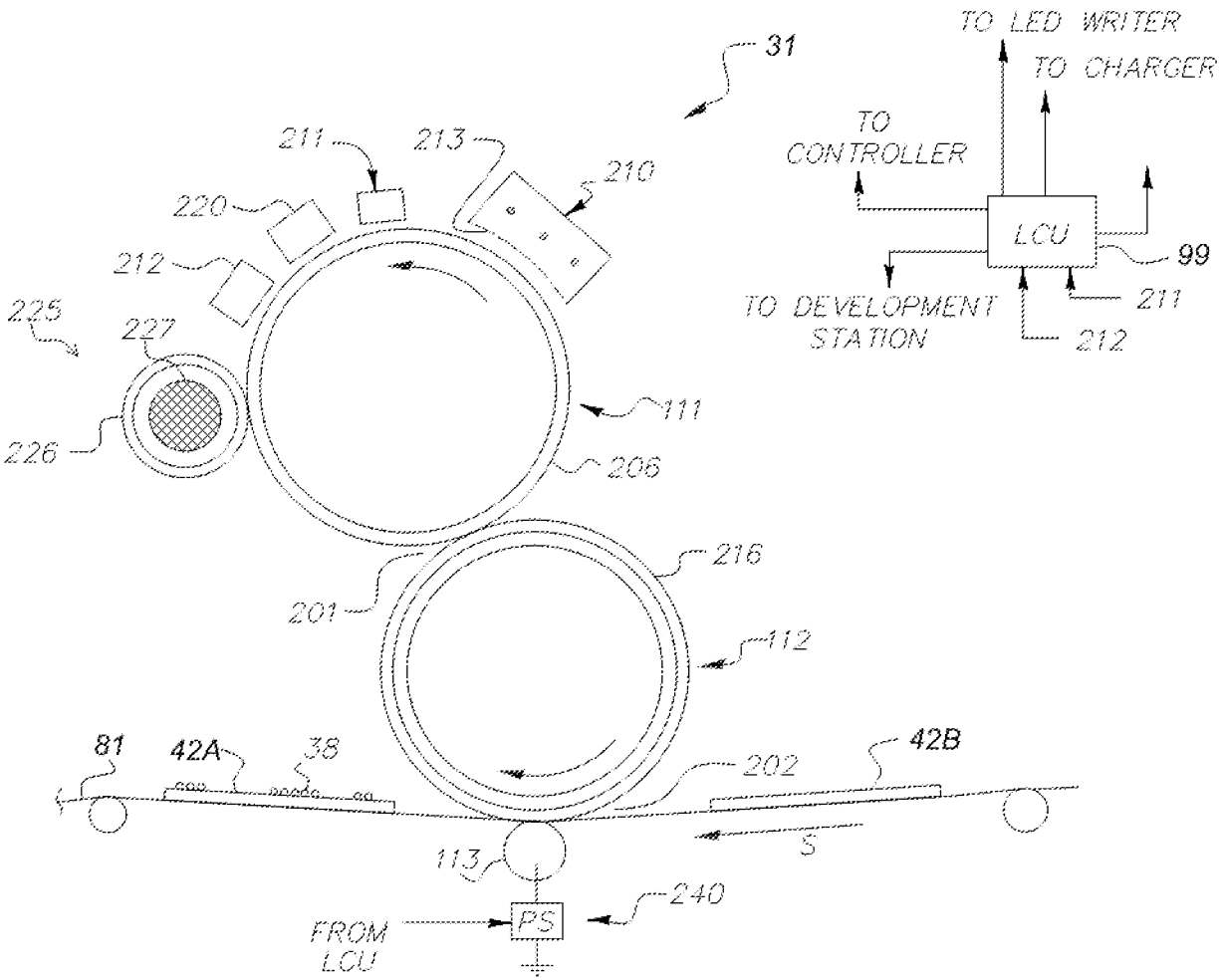
FIG. 3 is an elevational cross-section of one printing module of the apparatus of FIG. 1.

FIGS. 1-3 are elevational cross-sections showing portions of a typical electrophotographic printer 100 useful with various embodiments. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver 42, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver 42, and that all five colors participate to form process colors in at least some of the subsets. That is, each of the five colors of toner can be combined with toner of one or more of the other colors at a particular location on the receiver 42 to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers 42 to fuser 60, which fixes the toner particles to the respective receivers 42 by the application of heat and pressure. The receivers 42 are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g., silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver 42.

The receivers (e.g., receiver 42B) carrying the fused image (e.g., fused image 39) are transported in a series from the fuser 60 along a path either to a remote output tray 69, or back to printing modules 31, 32, 33, 34, 35 to create an image on the backside of the receiver 42, i.e. to form a duplex print. Receivers 42 can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of the respective LED writers, e.g., for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g., color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Referring to FIG. 2, receivers $R_n$-$R_{(n-6)}$ are delivered from supply unit 40 (FIG. 1) and transported through the printing modules 31, 32, 33, 34, 35. The receivers 42 are adhered (e.g., electrostatically using coupled corona tack-down chargers 124, 125) to an endless transport web 81 entrained and driven about rollers 102, 103. Each of the printing modules 31, 32, 33, 34, 35 includes a respective imaging component (111, 121, 131, 141, 151), e.g., a roller or belt, an intermediate transfer component (112, 122, 132, 142, 152), e.g., a blanket roller, and transfer backup component (113, 123, 133, 143, 153), e.g., a roller, belt or rod. Thus in printing module 31, a print image (e.g., a black separation image) is created on imaging component PC1 (111), transferred to intermediate transfer component ITM1 (112), and transferred again to receiver $R_{(n-1)}$ moving through transfer subsystem 50 (FIG. 1) that includes transfer component ITM1 (112) forming a pressure nip with a transfer backup component TR1 (113). Similarly, printing modules 32, 33, 34, and 35 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). The direction of transport of the receivers is the slow-scan direction; the perpendicular direction, parallel to the axes of the intermediate transfer components (112, 122, 132, 142, 152), is the fast-scan direction.

A receiver, $R_n$, arriving from supply unit 40 (FIG. 1), is shown passing over roller 102 for subsequent entry into the transfer subsystem 50 (FIG. 1) of the first printing module, 31, in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35. An unfused print image formed on receiver $R_{(n-6)}$ is moving as shown towards fuser 60 (FIG. 1).

A power supply 105 provides individual transfer currents to the transfer backup components 113, 123, 133, 143, and 153. LCU 99 (FIG. 1) provides timing and control signals to the components of printer 100 in response to signals from sensors in printer 100 to control the components and process control parameters of the printer 100. A cleaning station 86 for transport web 81 permits continued reuse of transport web 81. A densitometer array includes a transmission densitometer 104 using a light beam 110. The densitometer array measures optical densities of five toner control patches transferred to an interframe area 109 located on transport web 81, such that one or more signals are transmitted from the densitometer array to a computer or other controller (not shown) with corresponding signals sent from the computer to power supply 105. Transmission densitometer 104 is preferably located between printing module 35 and roller 103. Reflection densitometers, and more or fewer test patches, can also be used.

FIG. 3 shows more details of printing module 31, which is representative of printing modules 32, 33, 34, and 35 (FIG. 1). Primary charging subsystem 210 uniformly electrostatically charges photoreceptor 206 of imaging component 111, shown in the form of an imaging cylinder. Charging subsystem 210 includes a grid 213 having a selected voltage. Additional components provided for control can be assembled about the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g., laser or LED writers), and the respective development station 225 of each printing module 31, 32, 33, 34, 35 (FIG. 1), among other components. Each printing module can also have its own respective controller (not shown) coupled to LCU 99.

Imaging component 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging component 111, which can be a plate, drum, or belt. Photoreceptors can include a homogeneous layer of a single material such as vitreous selenium or a composite layer containing a photoconductor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g., of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor 206 in the fast-scan direction. One dot site is exposed at a time, and the intensity or duty cycle of the laser beam is varied at each dot site. In embodiments using an LED array, the array can include a plurality of LEDs arranged next to each other in a line, dot sites in one row of dot sites on the photoreceptor 206 can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 or receiver 42 (FIG. 1) which the light source (e.g., laser or LED) can expose with a selected exposure different from the exposure of another engine pixel. Engine pixels can overlap, e.g., to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, for applying toner of a selected color to the latent image on photoreceptor 206 to produce a visible image on photoreceptor 206. Development station 225 is electrically biased by a suitable respective voltage to develop the respective latent image, which voltage can be supplied by a power supply (not shown). Developer is provided to toning shell 226 by a supply system (not shown), e.g., a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. Development station 225 can also employ a mono-component developer comprising toner, either magnetic or non-magnetic, without separate magnetic carrier particles.

Transfer subsystem 50 (FIG. 1) includes transfer backup component 113, and intermediate transfer component 112 for transferring the respective print image from photoreceptor 206 of imaging component 111 through a first transfer nip 201 to surface 216 of intermediate transfer component 112, and thence to a receiver (e.g., 42B) which receives the respective toned print images 38 from each printing module in superposition to form a composite image thereon. Print image 38 is e.g., a separation of one color, such as cyan. Receivers 42 are transported by transport web 81. Transfer to a receiver 42 is effected by an electrical field provided to transfer backup component 113 by power source 240, which is controlled by LCU 99. Receivers can be any objects or surfaces onto which toner can be transferred from imaging component 111 by application of the electric field. In this example, receiver 42B is shown prior to entry into second transfer nip 202, and receiver 42A is shown subsequent to transfer of the print image 38 onto receiver 42A.

Figure 4:
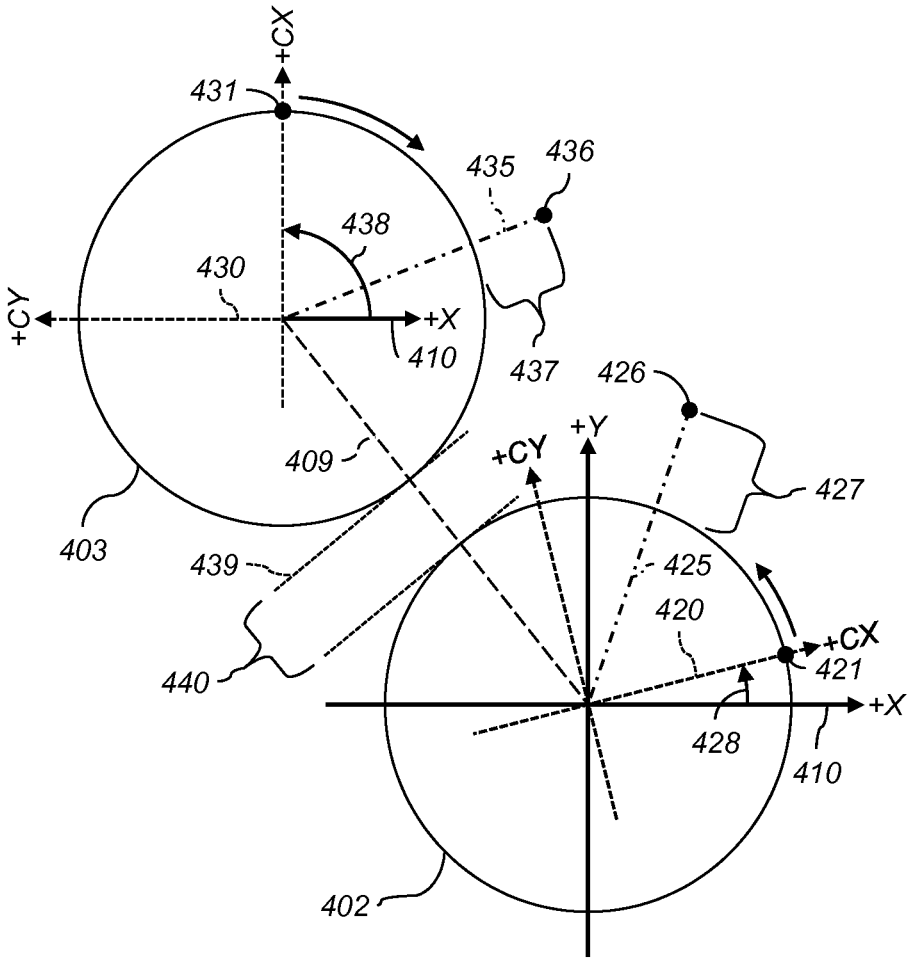
FIG. 4 shows components of a printer and illustrates terms used in this application.

FIG. 4 shows components of a printer and illustrates terms used in this application. A reference coordinate frame 410 (shown in solid lines) is defined, e.g., with respect to the chassis of the printer, or the Earth. The term "angular position" of a component or member, as used herein, refers to the angle clockwise to a selected index point rotating with the component from the +X axis of reference coordinate frame 410, when the center of reference coordinate frame 410 is taken to be the center of rotation of the component.

The printer includes first rotatable imaging component 402 and either a surface (e.g., along tangent line 439) or second rotatable imaging component 403. An example of an imaging component and a surface is an electrophotographic (EP) photoreceptor as imaging component 402, and a receiver (e.g., a sheet of paper) as the surface coincident with tangent line 439 near imaging component 402. An example of two imaging components is an EP toning roller as imaging component 402 and an EP photoreceptor as imaging component 403. Imaging components can include toning stations, photoconductors, or intermediates, either belt (web) or cylinder (drum).

The rotation of imaging components 402, 403 is indicated herein by respective index points 421, 431. Through each index point 421, 431 passes the +CX axis of a component coordinate frame 420, 430, respectively (shown in dashed lines). Component coordinate frames 420, 430 rotate with respective imaging components 402, 403. The term "angle of rotation" of a component refers to the angular position of the index point 421, 431 for that component. In the example shown, the angle of rotation of imaging component 402 is approximately 14°, and the angle of rotation of component 403 is 90°. Angles of rotation are in the half-closed interval [0°, 360°). Imaging component 402 is rotating counter-clockwise, so its angle of rotation 428 is increasing from 14° to <360°, then starting over at 0°. Component 403 is rotating clockwise, so its angle of rotation 438 is decreasing from 90° to 0°, then starting over at <360°.

Runout axis 409 extends between the first and second rotatable imaging components 402, 403 and passes through a selected point of interest. The point of interest is a point at which variations in nip spacing 440 between the members affects the imaging performance of the printer 100. In various embodiments in which imaging component 402 or imaging component 403 is a drum, runout axis 409 passes through the center of rotation of the drum and the point at which nip spacing 440 is the smallest over a full beat period of the components. The beat period is the reciprocal of the difference between the frequencies of rotation of components 402, 403. In embodiments in which components 402 and 403 are both drums, runout axis 409 passes through the centers of rotation of components 402, 403. Nip spacing 440 between the surfaces of components 402, 403 along runout axis 409 varies over time due to runout and other mechanical or electrical variations in components 402, 403 or their mount(s) or drive(s). Similarly, in embodiments using a component and a surface, nip spacing 440 varies over time due to variations in imaging component 402 and the surface, or the mounting or drive of either or both. In some embodiments, as discussed below, nip spacing 440 is measured directly along axis 409. In other embodiments, distances are measured at other points around the components.

In the example shown, distance 427 between first reference point 426 and the surface of first imaging component 402 is measured along first reference axis 425. Similarly, distance 437 between second reference point 436 and the surface of second component 403 is measured along second reference axis 435. Reference axes 425, 435 have respective selected angular positions determined by the measurement hardware, as will be discussed below.

Figure 5:
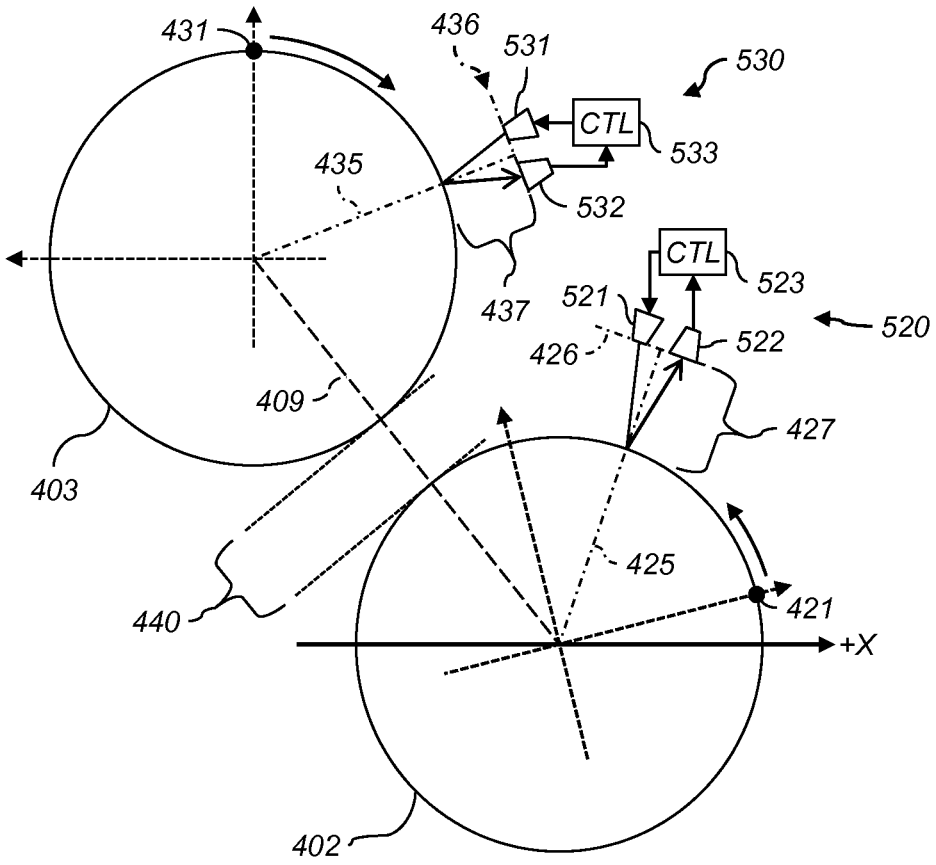
FIG. 5 shows measurement hardware according to various embodiments.

FIG. 5 shows measurement hardware according to various embodiments. First rotatable imaging component 402 with index point 421 is as shown in FIG. 4, and can be a toning station, photoconductor, intermediate, or other belt or drum imaging component. First runout sensor 520 measures distance 427 between first reference point 426, which can be a fixed point on the chassis of the printer 100 outside imaging component 402, and the surface of first imaging component 402 along first reference axis 425. As discussed above, in this example, reference axis 425 is not runout axis 409, since periodic signals can be phase-shifted to determine the runout along runout axis 409. A phase-locked loop can be used to perform this shifting. In an embodiment, as shown here, sensor 520 is far enough ahead of runout axis 409 in the direction of rotation of imaging component 402 that there is time to measure and process the data from sensor 520 before it is reacted to along runout axis 409. This will be discussed further below. Sensor 520 can be a capacitive runout or distance sensor, a sonar, laser, radar, or LIDAR rangefinder, a dial indicator having a spring-loaded arm in mechanical contact with the rotating surface of imaging component 402, or another distance measurement sensor. In the example shown, sensor 520 is a laser rangefinder that measures the round-trip time of a laser photon reflecting off the surface of imaging component 402, divides by two, and corrects for the separation between the emitter and the receiver to obtain the straight-line (rather than hypotenuse) distance between the emitter/receiver pair at reference point 426 and the surface of imaging component 402 along first reference axis 425. The hypotenuse distance can also be used. Photons are emitted by emitter 521 and received by receiver 522. The distance is computed by controller 523, which can also be part of LCU 99 (FIG. 1).

Second rotatable imaging component 403 with index point 431 are as shown in FIG. 4. Second runout sensor 530 can be any of the types of hardware described above, and can be of a different type than sensor 520. Sensor 530 measures the distance 437 between second reference point 436 and the surface of second imaging component 403 along second reference axis 435. This advantageously permits determining nip spacing 440 without making any assumptions about the runout of imaging component 403. This is particularly useful when components 402 and 403 form a toning nip, in which spacing variations due to either component's runout can result in objectionable artifacts. In this example, emitter 531, receiver 532, and controller 533 are as discussed above for sensor 520.

Figure 6:
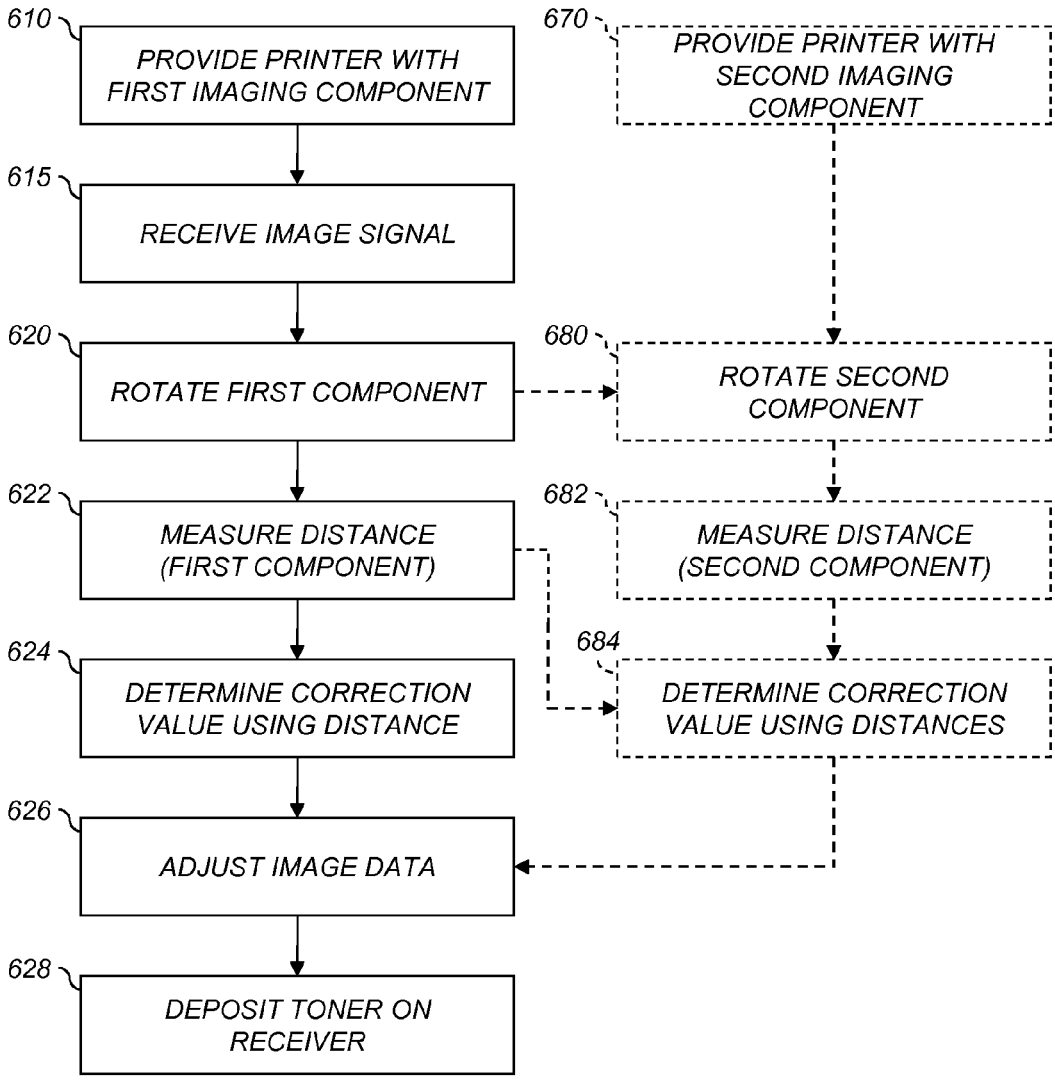
FIGS. 6 and 7 show methods for compensating for periodic nonuniformity in an electrophotographic (EP) printer.

FIG. 6 shows methods for compensating for periodic nonuniformity in an electrophotographic (EP) printer. In some embodiments, shown in steps 610-628, periodic nonuniformity is compensated with respect to a first imaging component. In other embodiments, shown in steps 670-684, 626, and 628, periodic nonuniformity is compensated with respect to a first and a second imaging component. Both advantageously de-confound multiple image-quality artifacts by measuring components directly. This is simpler than determining which frequency components of an FFT on a complex toner-measurement waveform correspond to which imaging component. Embodiments with one imaging component are considered first; processing begins with step 610.

In step 610, an EP printer is provided. The printer includes a first rotatable imaging component (e.g., a toning station, photoconductor, or intermediate), as discussed above with reference to FIGS. 4 and 5. The printer also includes a first runout sensor for measuring the distance between a first reference point and the surface of the first component along a first reference axis, as discussed above with reference to FIGS. 4 and 5. Step 610 is followed by step 615.

In step 615, an image signal representing an image to be produced on a receiving member by the printer is received. Examples of a receiving member include receiver 42 (FIG. 1), a piece, web, or sheet of paper, or photoreceptor 206 (FIG. 3). The image signal includes image data representing, e.g., the density of each toner to be applied to the receiving member at each of a plurality of locations. Step 615 is followed by step 620.

In step 620, the first component is rotated. While the first component is rotating, steps 622, 624, 626, and 628 are performed. Step 620 is followed by step 622.

In step 622, the distance for the first component is measured using the first runout sensor. Step 622 is followed by step 624.

In step 624, a correction value is automatically determined using a processor (e.g., LCU 99, FIG. 1). The correction value corresponds to the measured distance, and optionally to the image data. In an embodiment, the processor uses a model developed during the design of the printer to map the measured distance to the correction value. Such a model can be made by printing test targets at various distances and measuring the density error (with reference to a selected aim density) as a function of distance. The density error corresponding to the distance measured in step 622 can be determined using the model, and that density error can be negated or inverted to determine a correction value that will undo the effects of the error. Compensation is discussed in more detail below, following the discussion of FIG. 10. Step 624 is followed by step 626.

In step 626, the processor automatically adjusts the image data that corresponds to the measured distance with the determined correction value. Step 626 is followed by step 628.

Referring back to FIG. 4, since reference axis 425 does not necessarily coincide with runout axis 409, the correction value is matched with the image data on or near reference axis 425 at the time of measurement. When the image data are used in the imaging process, which can be some time later, the correction value matched to the image data is used to adjust the image data. The correction value can also be applied immediately to the image data, and the corrected image data delayed until the appropriate time for their use in the imaging process. The adjustment of image data is described in more detail below, following the discussion of FIG. 10.

In one example, imaging component 402 is the photoreceptor, second imaging component 403 is not used, and the exposure system is aligned with runout axis 409. Reference axis 425 has an angular position of 70°, and runout axis 409 has an angular position of 130°. Measurements taken on reference axis 425 are applied to image data before or at the time of writing the latent image onto the photoreceptor 206, 60° of rotation of photoreceptor 206 (imaging component 402) after the measurement was taken.

Referring back to FIG. 6, in step 628, toner corresponding to the adjusted image data is deposited on the receiver using the first component, and optionally other components. In an electrophotographic printer, depositing toner involves a photoreceptor 206 and a receiver 532 and can also employ an intermediate component and a transfer backup component.

In embodiments in which periodic nonuniformity is compensated with respect to a first and a second imaging component, steps 610-628 are used. These embodiments are particularly useful when the ratio of the rotation periods of the two components is irrational, so there is no periodic recurrence of the same artifact pattern. These embodiments also measure nip spacing without requiring parts in the nip. Nip spacing is commonly measured on development equipment, which advantageously permits process improvement by more making Additional processing starts at step 670.

In step 670, the printer is provided with a second rotatable imaging component (e.g., 403, FIG. 5) arranged to cooperate with the first rotatable imaging component in producing the image on the receiving member. A second runout sensor (e.g., 530, FIG. 5) is provided to measure the distance between a second reference point and the surface of the second imaging component along a second reference axis. The second rotatable imaging component can be adjacent to the first imaging component, can form a nip with the first, or can have a role in the imaging process for which variations in nip spacing 440 affect image quality. Step 670 is followed by step 680. In these embodiments, step 620 is also followed by step 680.

In step 680, while the first component is rotating, the second component is rotated, and steps 682-684 are performed while the second component rotates, as are steps 622-628. Step 680 is followed by step 682.

In step 682, the distance for the second component is measured using the second runout sensor. This provides a measurement of nip spacing 440 when adjusted for the difference in angular position between the reference axes (e.g., 425, 435) and runout axis (e.g., 409) (all shown in FIG. 5). Step 682 is followed by step 684.

In step 684, a correction value is automatically determined by the processor. The correction value corresponds to the respective measured distances for the first and second components, and optionally the image data. The measured distance for the first imaging component was determined in step 622, as discussed above, and is provided to step 684. The processor can use a model to determine the correction value, as discussed above. Step 684 is followed by step 626.

In step 626, the processor automatically adjusts the image data corresponding to the measured distances with the correction value. The correction value can be a joint correction for the combined effect of both components. The correction value can also include two different values, one for the first component and one for the second.

In step 628, toner corresponding to the adjusted image data is deposited on the receiver using the first and second components, and optionally others.

Figure 7:
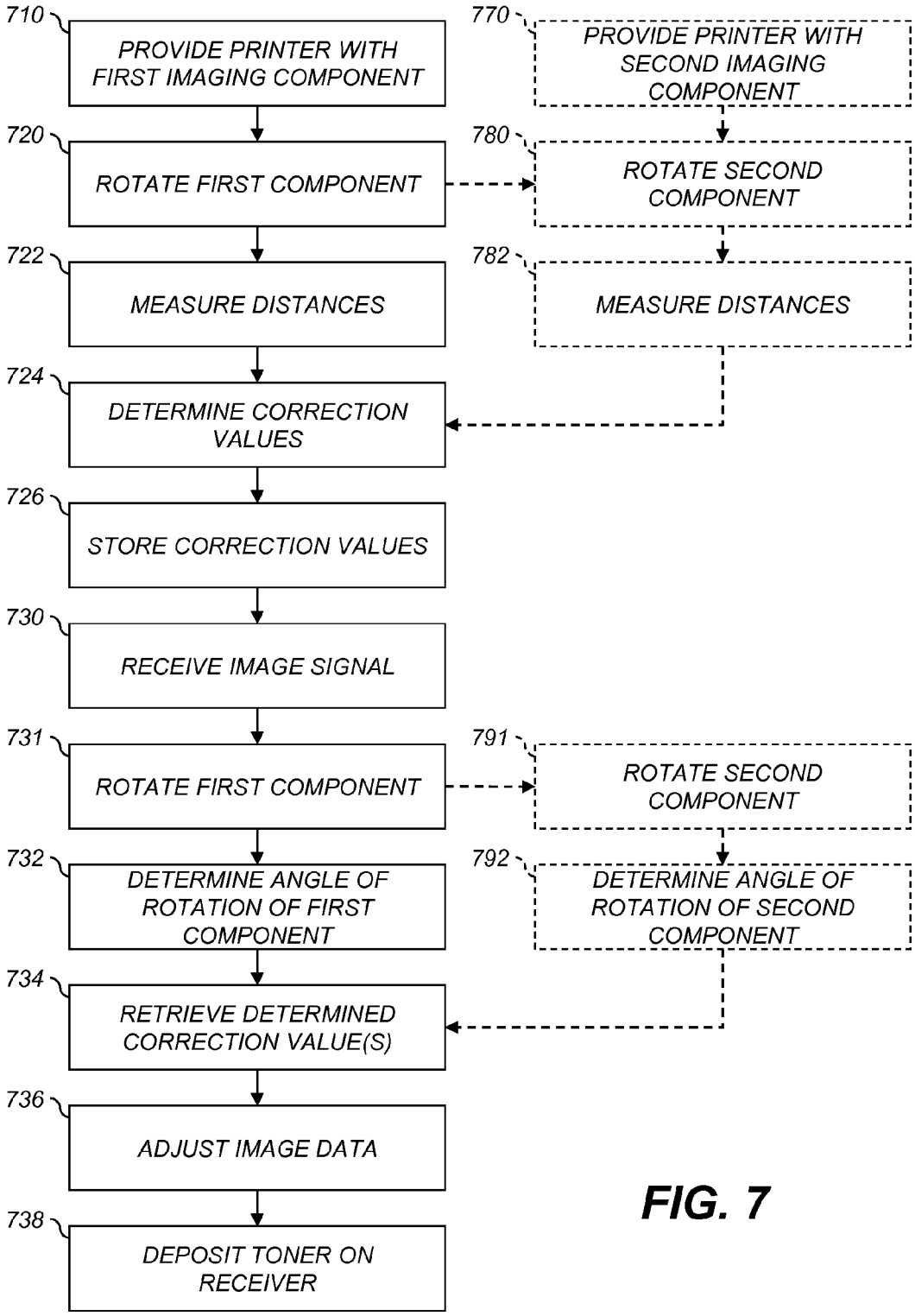

FIG. 7 shows methods for compensating for periodic nonuniformity in an electrophotographic (EP) printer. In some embodiments, shown in steps 710-738, periodic nonuniformity is compensated with respect to a first imaging component. In other embodiments, shown in steps 710-738 and also 770-792, periodic nonuniformity is compensated with respect to a first and a second imaging component. Both advantageously de-confound multiple image-quality artifacts by measuring components directly, as discussed above. These embodiments are particularly useful in systems with replaceable components that can be measured and calibrated before shipment to a customer site. Correction values can be stored in a memory shipped with each replaceable component, and those values can be used at the time of printing to compensate for nonuniformity. Embodiments with one imaging component are considered first; processing begins with step 710.

In step 710, the EP printer is provided. The printer includes a rotatable imaging component and a runout sensor for measuring the distance between a reference point and the surface of the rotatable imaging component along a reference axis, as discussed above with reference to FIG. 5. Step 710 is followed by step 720.

Step 720 is a first rotating step of rotating the rotatable imaging component. Step 720 is followed by step 722 and optionally, as will be discussed below, by step 780.

In step 722, while the rotatable imaging component is rotating, respective distances are measured at a plurality of angles of rotation of the imaging component using the runout sensor, as discussed above. For example, the distance can be measured when the imaging component is at an angle of rotation of 0°, 45°, 90°, . . . , 315°. As the imaging component rotates, when index point 431 (FIG. 4) (which defines the 0° angle of rotation) reaches the reference axis (e.g., 435, FIG. 4), a measurement is taken. 15° later, another measurement is taken along the reference axis, and this process repeats until the desired measurements have been taken. The measured distances are designated as respective first distances. Step 722 is followed by step 724.

In step 724, respective correction values corresponding to one or more of the measured first distances are automatically determined using a processor, as discussed above. Different correction values can be determined for different density levels or halftone patterns. Correction-value computation is discussed further below, following the discussion of FIG. 10. Step 724 is followed by step 726.

In step 726, the correction values and corresponding angles of rotation are stored in a memory, such as a RAM, ROM, HDD, Flash, core, or other volatile or non-volatile memory. Alternatively, the measured distances can be stored in the memory, and correction computed later, as discussed below. Step 726 is followed by step 730.

In step 730, an image signal representing a print image to be deposited on a receiver by the printer is received. Step 730 is followed by step 731.

Step 731 is a second rotating step of rotating the rotatable imaging component. While the rotatable imaging component is rotating, steps 732, 734, 736, and 738 are performed. Step 731 is followed by step 732 and optionally by step 791 (discussed below).

In step 732, an angle of rotation 428 of the first imaging component 402 is determined, e.g., using an encoder or a timer. Referring back to FIG. 4, In some embodiments, an encoder on the shaft, surface, or end of the imaging component 402 directly measures and reports the absolute or relative angle of rotation 428. If relative, a zeroing process can be performed at startup of the printer 100, or periodically during operation of the printer 100, to relate relative angles of rotation to absolute angles of rotation 428, 438. In other embodiments, the angular velocity of the component (measured, or retrieved from a memory) is multiplied by the time the imaging component 402, 403 has been rotating to determine its absolute angle of rotation 428, 438. In these embodiments, the imaging component 402, 403 can periodically be positioned at a homing position, e.g. rotated against a selectively-engageable mechanical stop. While the imaging component 402, 403 is at the homing position, the time of rotation is set to zero. This causes the integrated angular-position error since the last homing operation to be zero. Angular position of an imaging component 402, 403 can also be inferred using encoder readings of other rotatable components in contact with that imaging component 402, 403. Referring back to FIG. 7, step 732 is followed by step 734.

In step 734, one or more determined correction value(s) corresponding to the determined angle of rotation are retrieved. In some embodiments, the image data are also used to determine which correction value(s) to retrieve. In embodiments in which the distances are stored in memory, the distances are retrieved and one or more correction value(s) are determined, as described above with respect to step 724. Step 734 is followed by step 736.

In step 736, the image data corresponding to the determined angle of rotation are automatically adjusted with the correction value(s) using the processor, as discussed above. Step 736 is followed by step 738.

In step 738, toner corresponding to the adjusted image data is deposited on the receiver using the rotatable imaging component, and optionally other components, as described above.

In various embodiments, interpolation is additionally used to compensate with finer resolution than the resolution at which measurements were taken. Specifically, step 734 includes retrieving from the memory two determined correction values and the corresponding angles of rotation. Step 736 includes interpolating between the two retrieved correction values using the determined angle of rotation and the retrieved angles of rotation. In this way, measurements taken, e.g., every 30° around the imaging component can be used to compensate for image data every 5°, or every 1°. In embodiments in which distances rather than correction values are stored in memory, two stored measured distances and the corresponding angles of rotation are retrieved from memory. Correction values corresponding to the retrieved distances are determined. The determined correction values are interpolated.

In embodiments in which periodic nonuniformity is compensated with respect to a first and a second imaging component, steps 770-792 are used with steps 710-738. These embodiments are particularly useful when the ratio of the rotation periods of the two imaging components is irrational, so there is no periodic recurrence of the same artifact pattern. As discussed above, these embodiments provide a direct readout of nip spacing, but do not require intrusive measurement equipment to be present in the nip. Processing starts at steps 710 and 770.

In steps 710 and 770, and referring to FIGS. 4 and 5 for an example, the EP printer is provided with first and second rotatable imaging components 402, 403 arranged to cooperate in producing the image on the receiving member, as discussed above. The components can be, e.g., adjacent, nip-forming, or arranged so that nip spacing 440 affects image quality. First and second runout sensors 520, 530 corresponding to the respective imaging components 402, 403 measure respective distances 427, 437 between respective reference points 426, 436 and the surfaces of the respective rotatable imaging components 402, 403 along respective reference axes 435, as shown in FIG. 5. Step 770 is followed by step 780.

Steps 720 and 780 compose a first rotating step, in which the first and second rotatable imaging components 402, 403 are rotated. Step 780 is followed by step 782.

In steps 722 and 782, while the first and second rotatable imaging components 402, 403 are rotating, the respective distances are measured at first and second pluralities of angles of rotation 428, 438 of the imaging components 402, 403 using the run-out sensors 520, 530. The first and second pluralities can include the same angles or different angles. That is, multiple angles of rotation 428, 438 of each imaging component 402, 403 are measured at the same angular position, that of the runout sensor 520, 530. These distances are designated as respective first distances 427 of the first imaging component 402 and second distances 437 of the second imaging component 403. Steps 722 and 782 are followed by step 724.

In step 724, in these embodiments, respective correction values are automatically determined using a processor. Each correction value corresponds to one or more of the measured first distances 427 and second distances 437. Step 724 is followed by step 726.

In step 726, the correction values and corresponding angles of rotation 428, 438 of the first and second components 402, 403 are stored in a memory. In other embodiments, the respective first and second distances 427, 437 and corresponding angles of rotation 428, 438 are stored. Step 726 is followed by step 730.

In step 730, an image signal is received that represents a print image to be deposited on a receiver 522, 432 by the printer 100. Step 730 is followed by steps 731 and 791.

Steps 731 and 791 compose a second rotating step of rotating the first and second rotatable imaging components. While the components are rotating, steps 732, 792, 734, 736, and 738 are performed. Step 791 is followed by step 792.

In steps 732 and 792, first and second angles of rotation 428, 438 of the respective imaging components 402, 403 are determined, e.g., using an encoder or a timer as discussed above. Both steps are followed by step 734.

In step 734, one or more determined correction value(s) corresponding to the determined angles of rotation 428, 438 of the first and second imaging components 402, 403, and optionally the image data, are retrieved from memory. In other embodiments, the stored distances 427, 437 are retrieved, and the correction value(s) are determined as described above. Step 734 is followed by step 736.

In step 736, the image data corresponding to the determined angles of rotation 428, 438 of the first and second imaging components 402, 403 are automatically adjusted with the correction value(s) using the processor. Step 736 is followed by step 738.

In step 738, toner corresponding to the adjusted image data is deposited on the receiver 522, 532 using the rotatable imaging components 402, 403, and optionally other components.

Interpolation can be used, or not, in combination with any of the embodiments described above with reference to FIGS. 6 and 7. By the same token, distances 427, 437 can be stored, or correction values stored, in any of these embodiments.

In various embodiments, interpolation is additionally used to compensate with finer resolution than the resolution at which measurements were taken. Specifically, step 734 includes retrieving from the memory two or more determined correction values and the corresponding angles of rotation 428, 438. Step 736 includes interpolating between the retrieved correction values using the determined first and second angles of rotation 428, 438 from steps 732 and 792, and using the retrieved angles of rotation. In this way, measurements taken, e.g., every 15° around the imaging components 402, 403 can be used to compensate for image data every 1°. This is the case even when the 15° increments are not aligned, i.e., when the points measured on the first and second imaging components 402, 403 do not rotate to align with runout axis 409 (FIG. 5) at the same time. As discussed above, in other embodiments, distances are stored in memory. Two or more measured distances 427, 437 are retrieved from memory, as are the corresponding angles of rotation 428, 438. Correction values corresponding to the retrieved distances 427, 437 are determined. The determined correction values are interpolated.

In some embodiments, the first rotating step includes selecting the first and second pluralities of angles of rotation 428, 438 in a non-aligned manner. In this way, while the first and second imaging components 402, 403 rotate, no selected angle of rotation 428, 438 of the first imaging component 402 in the first plurality aligns with the runout axis 409 at substantially the same time as any selected angle of rotation of the second imaging component 403 in the second plurality. Referring back to FIG. 4, in an example, first imaging component 402 and second imaging component 403 rotate at 1 Hz (60 rpm), in phase (i.e., both reach an angle of rotation of 0° at the same time). The first plurality of angles of rotation is 0°, 15°, 30°, . . . , 345°. Runout axis 409 has an angular position of 130° with respect to first imaging component 402. Therefore, assuming first and second components 402, 403 begin rotating simultaneously at constant velocity with reference points 426, 436 both at angular positions of 0° at time t=0, measurement points in the first plurality reach runout axis 409 at t=361 ms (≈130/360, at which time reference point 426 reaches runout axis 409), 402 ms (≈130/360+15/360), 444 ms, . . . . The second plurality is selected so that measurement points in the second plurality reach runout axis 409 at different times.

Since runout axis 409 has an angular position of 130° with respect to first imaging component 402, it has an angular position of −40°=40° ahead of the +X axis in the direction of rotation (clockwise) of second imaging component 403. Therefore, reference point 431 at the 0° angle of rotation 438 of second imaging component 403 reaches runout axis 409 at t=111 ms (≈40/460). Consequently, in these embodiments, points 0°, 15°, . . . cannot be used as the second plurality, or the 90° angle of rotation of second imaging component 403 would reach runout axis 409 at t=361 ms, the same time the 0° angle of rotation of first imaging component 402 reaches runout axis 409. Therefore, the second plurality is selected to include different angles. For example, the second plurality is selected to be 10°, 25°, 40°, . . . , 355°. Therefore the 10° point reaches runout axis 409 at t=139 ms, the 25° at 181 ms, . . . . Consequently, the 0° point of first imaging component 402 reaches runout axis 409 at t=361 ms, the 10° point of second imaging component 403 reaches runout axis 409 at 389 ms, and the 15° point of first imaging component 402 reaches runout axis 409 at 402 ms. This pattern continues around both components. At no time does a measurement point on first imaging component 402 reach runout axis 409 at the same time as a measurement point on second imaging component 403. Since the measurement points are equally spaced in time around the imaging components 402, 403 (i.e., measurements are taken the same temporal frequency on both imaging components), no beat-frequency terms are present to cause measurement points to coincide along runout axis 409.

Specifically, in these embodiments a runout axis 409 is defined connecting the first and second rotatable imaging components 402, 403 and normal to both. The first rotating step includes selecting the first and second pluralities of angles of rotation 428, 438 so that, while the first and second imaging components 402, 403 rotate, no angle of rotation 428, 438 of the first imaging component 402 in the first plurality aligns with the runout axis 409 at substantially the same time as any angle of rotation 438 of the second imaging component 403 in the second plurality.

Figure 8:
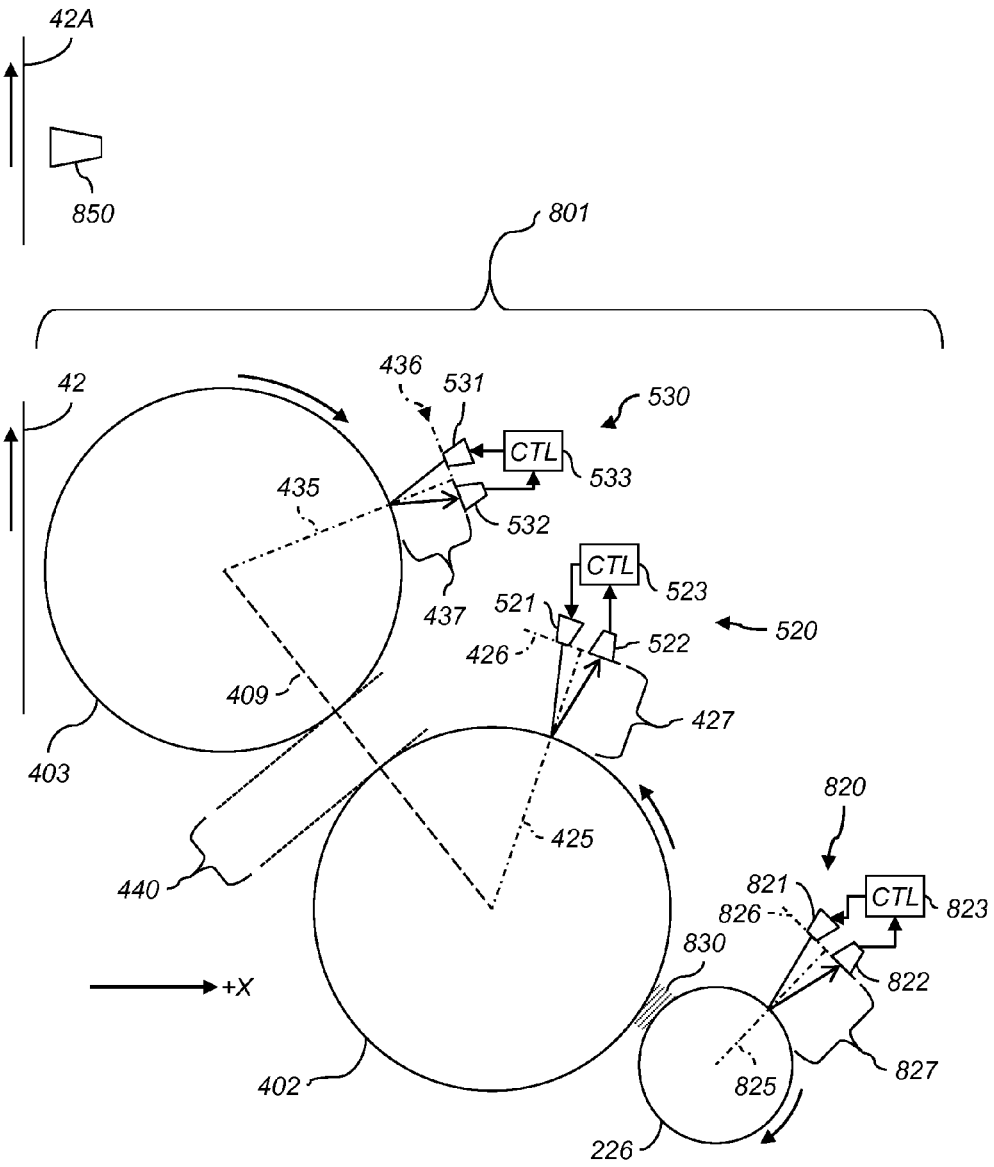
FIG. 8 shows components of a printer according to various embodiments for determining the cause of image artifacts.

FIG. 8 shows components of a printer 100 (FIG. 1) according to various embodiments for determining the cause of image artifacts. First imaging component 402 and second imaging component 403 are as shown in FIG. 5. In this example, first imaging component 402 is a photoreceptor and second imaging component 403 is an intermediate cylinder with a compliant surface. Nip spacing 440, runout axis 409, reference axes 425, 435, sensors 520, 530, controllers 523, 533, emitters 521, 531, receivers 522, 532, reference points 426, 436, distances 427, 437, and the +X axis are as shown in FIG. 5. Receiver 42 is as shown in FIG. 1. Toning shell 226 is as shown in FIG. 3, and transfers toner to first imaging component 402 in toning zone 830. Sensor 820 measures the distance 827 from reference point 826 to the surface of toning shell 226 along reference axis 825 using controller 823 controlling emitter 821 and receiver 822, as described above, e.g., with respect to sensor 520. Controls 523, 533, 823 can be part of, or their functions implemented by, LCU 99 (FIG. 1).

The printer 100 includes print engine 801 for producing an image on a receiving member, as discussed above. Print engine 801 has a plurality of rotatable imaging components (e.g., toning stations, photoconductors, intermediate cylinders or webs, or receiver drums). In this example, print engine 801 includes three imaging components: a toning component (226), a photoreceptor (402), and an intermediate cylinder (403). The imaging components 402, 403 can be driven directly by motors or servos, or indirectly by other imaging components. The printer also has a plurality of runout sensors 520, 530, 820, each for measuring the distance between a respective reference point 426, 436, 826 and the surface of the respective rotatable imaging component 402, 403, 226 along a respective reference axis 425, 435, 825. The printer can also include additional imaging components not equipped with runout sensors.

The printer 100 also includes artifact sensor 850 for detecting artifacts in the produced image and producing information identifying those artifacts. In various embodiments, the artifact sensor 850 measures the densities or potentials of one or more areas of the produced image. Densities can be measured on receiver 42A, as shown here, and can be measured using a line- or area-scan camera, e.g., a CCD, with a selected light source. Densities can be measured Densities can be measured in reflective or transmissive modes. Potentials can be measured on a photoreceptor, e.g., using an electrometer. Artifact sensor 850 can detect zero or more artifacts. As used herein, detecting "zero or more artifacts" refers to the fact that artifact sensor 850 can detect one or more artifacts, or can detect the absence of artifacts (i.e., zero artifacts).

Figure 9A:
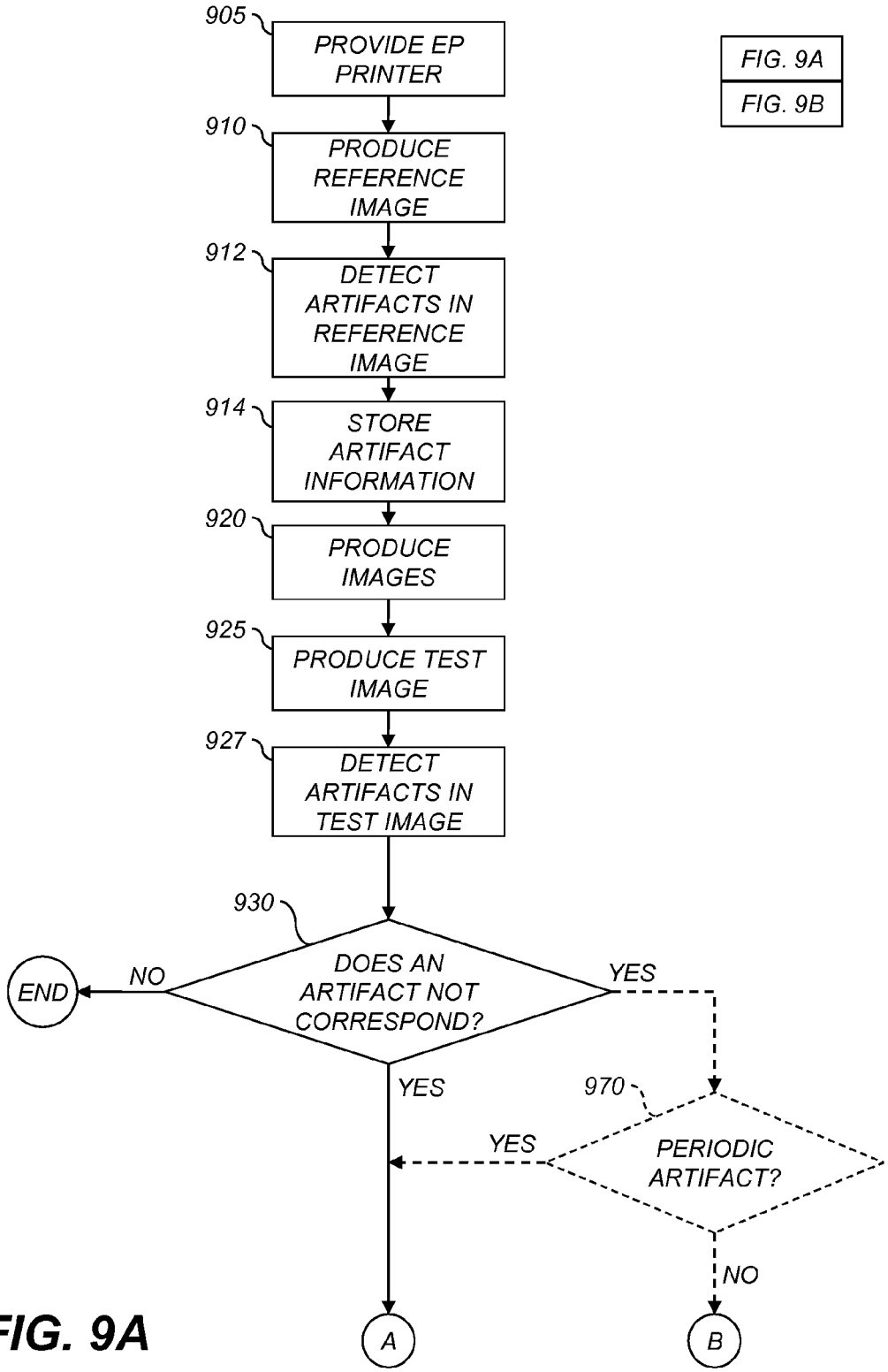
FIGS. 9 and 10 show methods for determining the cause of image artifacts produced by a printer according to various embodiments.
Figure 9B:
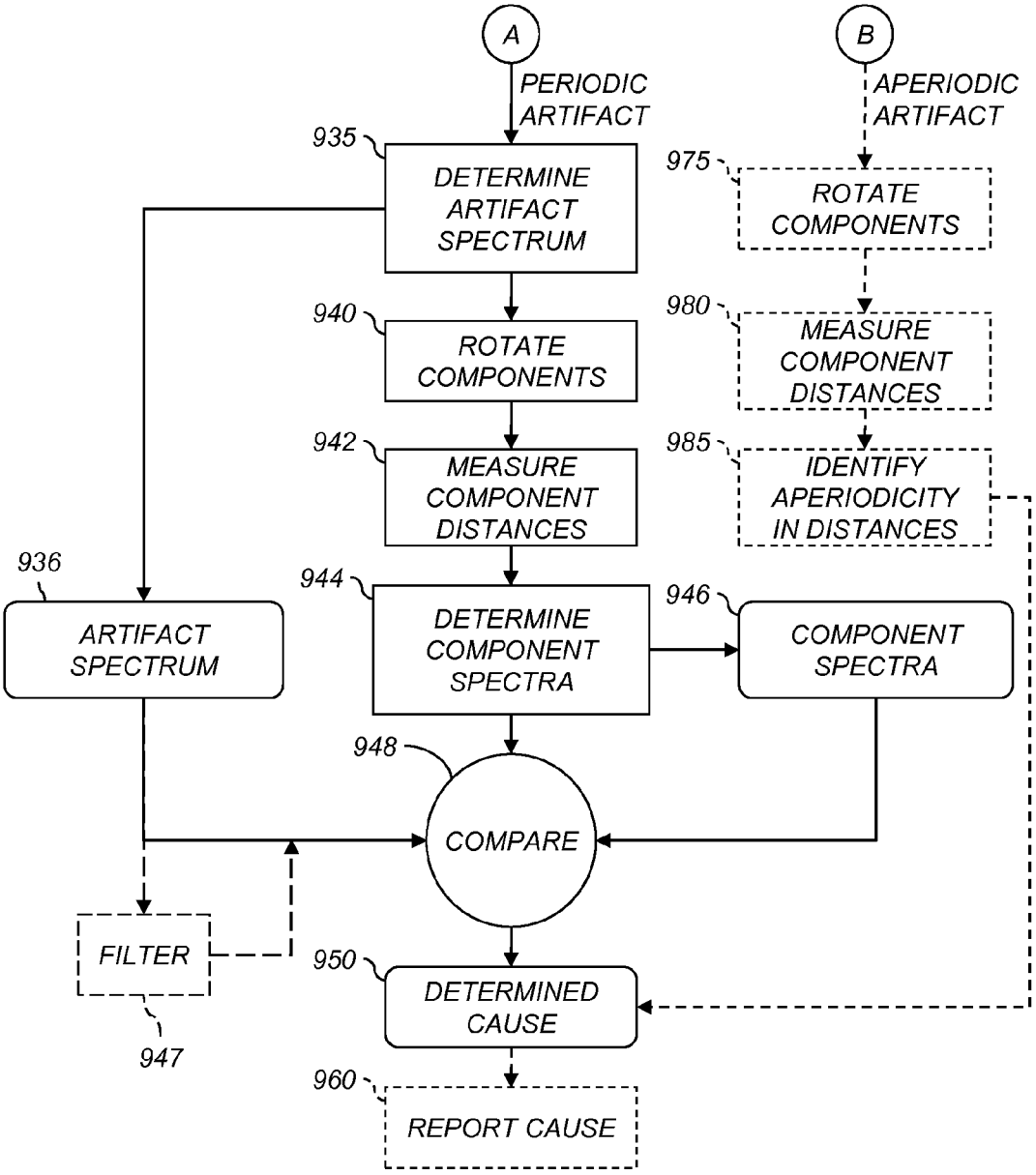

FIGS. 9A and 9B show a method for determining the cause of artifacts in images produced by an electrophotographic (EP) printer according to various embodiments. In these embodiments, artifact data (e.g., density or potential measurements) are used together with distance data (e.g., runout measurements) to determine which imaging component(s) 402, 403 are causing image artifacts. In embodiments, image artifacts are monitored, and when an image artifact changes, its frequency spectrum is compared to a spectrum of distances for various components to determine which corresponds. Processing begins with step 905.

In step 905, the EP printer is provided, e.g., as shown in FIG. 8. Step 905 is followed by step 910.

In step 910, a reference image is produced using the print engine. The reference image can include areas of various densities at various cross-track and in-track positions in the image. In an embodiment, the reference image includes a plurality of strips of constant aim density, each strip extending in-track, the strips adjacent to each other (optionally separated by a margin) along the cross-track direction. The reference image is selected to exhibit measurable artifacts, i.e., measurable variations in density or potential, when the imaging components develop variations. Step 910 is followed by step 912.

In step 912, zero or more artifacts are detected in the reference image using the artifact sensor 850. That is, one or more artifacts, or the absence of artifacts, is detected. The artifact sensor 850 is described above. Step 912 is followed by step 914.

In step 914, information identifying the detected artifacts is stored in a memory, e.g., a RAM, ROM, HDD, Flash, EEPROM, or other volatile or nonvolatile memory. Storing information about zero artifacts is performed by storing information indicating that no artifacts were detected. In an example, storing the information includes storing a count field into memory that holds the number of artifacts detected, and storing a specific-information record (e.g., containing frequency and phase) for each artifact into memory after the count field. If the stored count field is zero, no specific-information records are stored in memory. Step 914 is followed by step 920.

Steps 910-914 can be performed at each power-up of the printer 100, or periodically while the printer 100 is operating, or at designated service intervals. They can also be performed at the start-of-life of the printer and at each subsequent maintenance event in which one or more of the imaging component(s) is replaced.

In step 920, one or more images are produced using the print engine. This step can include normal operation for any amount of time desired. For example, the printer can be operated to produce customer print images for a standard service interval, e.g., 1000 pages or one month. This step can also include a stress test. A stress test can include printing a small number of high-density or high-quality images in a short time. Step 920 is followed by step 925.

In step 925, a test image is produced using the print engine. In an embodiment, the test image has the same aim image content as the reference image. The test image is selected to exhibit artifacts corresponding to the variations in the component(s). Step 925 is followed by step 927.

In step 927, zero or more artifacts in the test image are detected using the artifact sensor, as discussed above. In various embodiments, the test target has a length greater than the longest spatial period of rotation of an imaging component. In an embodiment, the test target is at least twice the circumference of the photoreceptor, e.g., the test target is at least 34" long or at least 44" long. In embodiments in which the photoreceptor is not the highest-diameter imaging component, the test target is at least as long as twice the circumference of the highest-diameter imaging component. In other embodiments, the test target is no longer than the spatial period of the lowest-frequency defect visible to the unaided human eye at a selected viewing distance. Step 927 is followed by decision step 930.

Decision step 930 determines whether at least one of the detected artifacts in the test image does not correspond to one of the zero or more artifact(s) detected in the reference image using the stored information. A processor is used to automatically compare any detected artifacts in the test image to the stored information identifying the artifacts in the reference image. In an example, each detected artifact (if any) is compared to each artifact stored. In another example, if the number of artifacts detected in the test image is different than the value in the stored count field (discussed above), at least one artifact does not correspond. For example, if there were no artifacts in the reference image (count=0) and there is one artifact in the test image, that artifact does not correspond to any artifact in the reference image.

If at least one detected artifact does not correspond, a printer malfunction can be present. Artifacts that are consistent over time can be corrected in various ways, as is discussed below. However, when the artifacts change, the correction is no longer as effective. Therefore, changes in banding or other effects can result in visible image artifacts on print images. If all objectionable artifacts in the test image correspond to artifacts in the reference image, the method is complete, since the printer already has stored information useful for performing compensation for the artifacts in the reference image (e.g., FIG. 12A). If at least one of the artifacts does not correspond (e.g., FIG. 13A), the next step is step 935 (FIG. 9B; connector "A"). In some embodiments, step 930 is followed by decision step 970 if a malfunction is present, as will be discussed below.

Continuing on FIG. 9B, in step 935, one of the non-corresponding image artifact(s) in the test image is selected. Steps 935-960 can be performed for each non-corresponding artifact in turn, or simultaneously. A characteristic frequency spectrum of the selected image artifact in the test image is determined. The frequency spectrum can be that of the detected image artifact in the test image, or that of the difference between the detected image artifact in the test image and the detected image artifact in the reference image. In this step, the artifact in the test image is periodic; aperiodic embodiments are discussed below with respect to FIG. 9B. Step 935 is followed by step 940 and produces spectrum 936.

Spectrum 936 is the characteristic frequency spectrum, or a part thereof, of the selected artifact in the test image. Spectrum 936 is provided to operation 948. Spectrum 936 is computed so that it can be compared to the frequency spectra of the imaging components to determine which component is experiencing variation. This will be discussed below with reference to spectra 946 and operation 948.

As used herein, "frequency spectrum" refers to selected, stored frequency or phase characteristics of a signal. In an embodiment, spectrum 936 is the Fourier transform of the artifact. In another embodiment, spectrum 936 is the discrete Fourier transform of the artifact, or the bottom half thereof, sampled at a selected sampling rate. The selected sampling rate is at least twice a selected frequency of expected variations in the imaging components 402, 403, or at least ten times that selected frequency. In another embodiment, spectrum 936 is the frequency, or frequency and phase, of the n highest peaks, for a selected integer $n \geqq 1$. In another embodiment, spectrum 936 is a histogram of signal amplitude or power over a selected range of frequencies, with selected bin spacings and centers. The spacings can be non-equal, and the bins can cover the entire selected range or a subset thereof. Using a frequency spectrum to characterize an artifact, rather than using the measured density values directly, permits comparison independent of the phase of the artifact with respect to the image. Therefore, various embodiments do not require phase sensors, once-around sensors, or other indicators of phase.

In step 940, at least two of the rotatable imaging components are rotated (simultaneously or sequentially; not all need to be rotated each time any one is rotated). While each rotatable imaging component is rotating, step 942 is performed.

In step 942, the respective distances of each imaging component are measured at a plurality of angles of rotation of that component using the respective runout sensor (located at the angular position of the respective reference axis), as discussed above. Imaging components can be measured simultaneously or sequentially. Zero or more imaging components can be rotated but not measured. Step 942 is followed by step 944.

In step 944, a respective characteristic frequency spectrum of each measured imaging component is determined using the corresponding measured distances. For example, an FFT can be performed on the measured distances over time to determine their frequency spectrum. Step 944 produces spectra 946 and is followed by operation 948.

Spectra 946 are the respective characteristic frequency spectra of each measured imaging component. Each spectrum can be any of the types described above for spectrum 936. Spectra 946 are provided to operation 948.

Operation 948 automatically compares the characteristic frequency spectrum of the selected image artifact in the test image (spectrum 936) to the respective characteristic frequency spectra of one or more of the measured imaging components (each part of spectra 946) to determine which imaging component(s) are causing the image artifact. Artifact spectrum 936 does not have to be compared to all the spectra in spectra 946. A match can be determined by selecting the lowest-magnitude error or weighted error between spectrum 936 and each spectrum in spectra 946. To make the comparison, the frequencies in the spectrum can be expanded, compressed, or shifted to correlate the image with the components. In various embodiments, spectrum 936 and spectra 946 are computed based on real time, so that frequencies correlate directly. Operation 948 produces cause 950.

Cause 950 is the component determined to be the cause of the artifact in the test image by comparison between spectrum 936 and each part of spectra 946. Cause 950 can be a single imaging component, or a plurality of components. Different imaging components can be determined to be the cause of respective, different artifacts. Cause 950 is provided to optional step 960.

In optional step 960, the determined cause of the artifact or malfunction is reported to an operator using an interface. The interface can be a screen, pager, printout, alert light, display on the printer, smartphone, or other device or system capable of presenting information to the operator. The operator can also be a service technician, and the interface can be a network (wired or wireless) over which the printer reports to the technician which imaging component needs to be replaced. In an embodiment, the printer periodically performs steps 925-960, e.g., according to a selected service schedule. The printer can perform steps 925-960 every week, every month, every 1,000 pages, or at another selected test interval. In various embodiments, when an artifact is located by this method, the printer automatically reports the determined cause to the service technician (operator) over the network (interface). This permits the service technician to bring the correct part(s) to the printer to service it, saving diagnostic effort and the technician's time.

Although density data are used to produce artifact spectrum 936, various embodiments use lower-resolution or lower-sensitivity density data than would be required to compensate using density data alone. Since the density data are used only to produce spectrum 936 for comparison in operation 948, the density measurements have a lower signal-to-noise (S/N) ratio requirements than those for density-based compensation.

In an embodiment, step 947 filters artifact spectrum 936 with selected one or more frequencies of interest in each element of component spectra 946 before comparison in operation 948. Filtering step 947 can also be performed as part of operation 948. In an example, when comparing artifact spectrum 936 to the first element of spectra 946, corresponding to a first imaging component, operation 948 notches out all frequencies but those within a respective guard band around each frequency of interest (e.g., the top five frequencies by power) in the spectrum of the first imaging component. This removes noise and de-confounds effects. Since noise at frequencies outside the range of interest is removed entirely, the frequency peaks inside the range of interest do not have to be as strong to overcome the noise. Therefore, the required S/N ratio of the density measurements is lower than it would be without the pre-filtering.

Specifically, in these embodiments, for each characteristic frequency spectrum of one of the measured imaging components in spectra 946, one or more frequencies of interest in the characteristic frequency spectrum are selected. The characteristic frequency spectrum of the selected image artifact in the test image (artifact spectrum 936) is filtered with the selected frequencies of interest (step 947) before comparing the spectrum of the artifact to the spectrum of the component (operation 948).

Referring back to FIG. 9A, in some embodiments, the cause can also be determined when an artifact in the test image is non-periodic, and therefore has no single spectrum 936 (FIG. 9B). After step 930 determines that at least one of the artifact(s) in the test image does not correspond, decision step 970 is performed.

In decision step 970, the processor automatically determines whether the selected image artifact in the test image is periodic. If it is, the next step is step 935 (FIG. 9B), as discussed above (connector "A"). If the selected artifact is not periodic, the next step is step 975 (FIG. 9B; connector "B").

Referring again to FIG. 9B, in step 975, if the selected artifact in the test image is not periodic, the rotatable imaging components are rotated, as described above (simultaneously or sequentially; not all need be rotated or measured). Step 975 is followed by step 980.

In step 980, while each rotatable imaging component is rotating, the respective distances are measured at a plurality of angles of rotation of the imaging component using the respective runout sensor. The plurality of angles includes angles in at least two revolutions, or $\geqq 2$ and $\leqq 100$ revolutions of the imaging component. Step 980 is followed by step 985.

In step 985, the processor automatically determines which of the imaging component(s) has measured distances that are aperiodic over the measured revolutions. In an example, the processor performs a Fourier transform of the measured distance data. If the frequency spectrum has more than a selected number of peaks with power above a selected percentage of DC, that spectrum is determined to be aperiodic. Alternatively, if the ratio of the power of the highest local maximum to the power of the lowest local maximum in the power spectrum (above DC) is less than a selected threshold (i.e., two peaks are similar in power), that spectrum is determined to be aperiodic. In another example, two sets of measurements are taken. If a majority of the peaks in the second set differ in frequency by more than a selected percentage or amount (e.g., 10%) from the frequencies of the closest peaks in the first set, the spectrum is determined to be aperiodic. When the distances for an imaging component are determined to be aperiodic, the cause of the imaging artifact is identified to include the imaging component(s) having such aperiodic distances. Step 985 produces cause 950.

Figure 10:
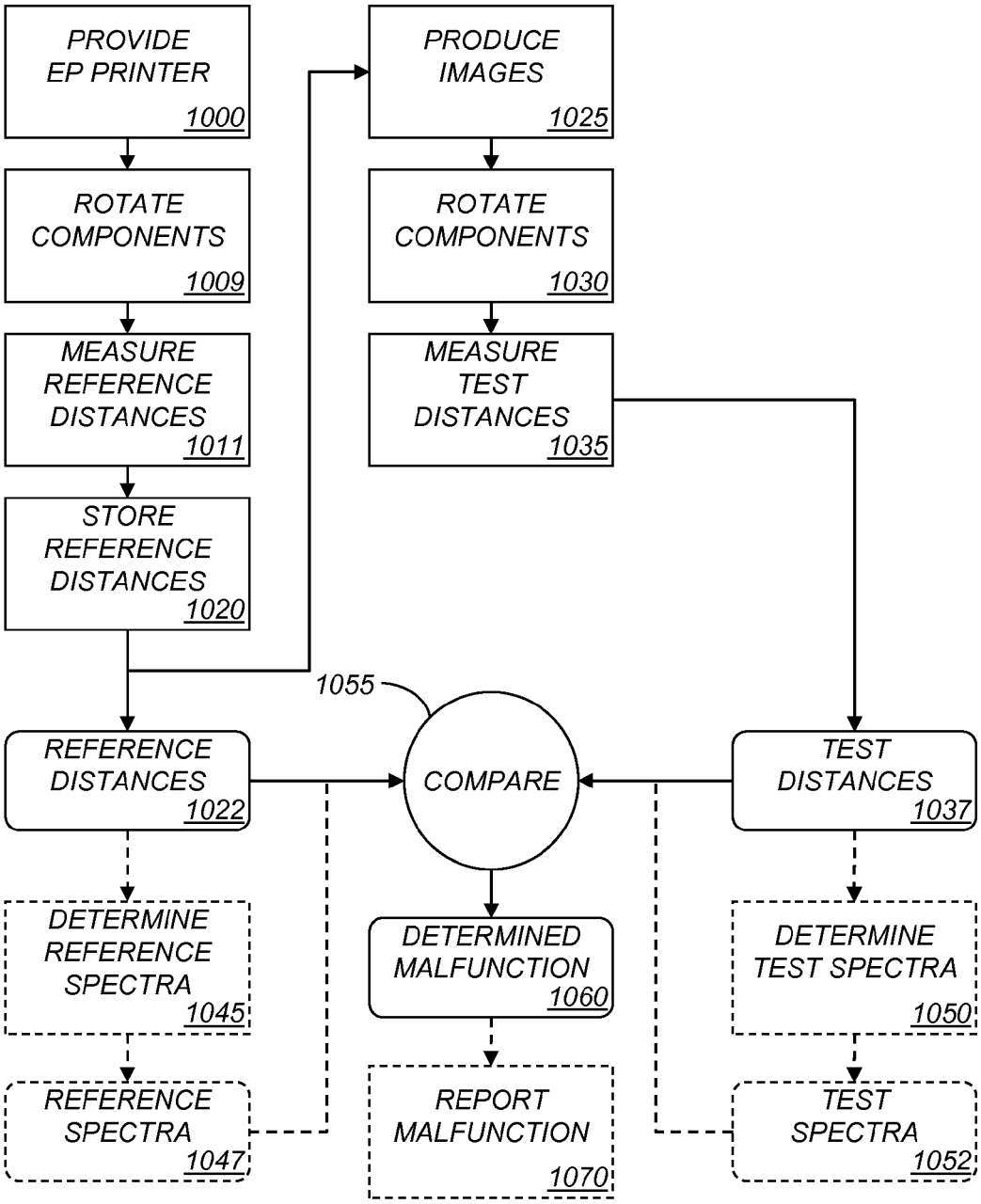

FIG. 10 is a flowchart of methods for indentifying malfunctions in an electrophotographic (EP) printer according to various embodiments. Identifying malfunctions can permit determining the cause of artifacts in images produced by the printer. These embodiments use distance data (e.g., runout measurements) to determine the causes of image artifacts without requiring direct measurements of those artifacts. In embodiments, runout is measured and monitored over time, and changes in runout determined to indicate malfunctions in the components experiencing changes. Processing begins with step 1000.

In step 1000, the EP printer is provided. The printer includes a print engine for producing an image on a receiving member (e.g., a piece of paper or a photoreceptor). The print engine includes a plurality of rotatable imaging components. The printer also includes a plurality of runout sensors for measuring the distance between a respective reference point and the surface of the respective rotatable imaging component along a respective reference axis. These components are as described above with reference to FIG. 8. Step 1000 is followed by step 1009.

In step 1009, which is a first rotating step, the rotatable imaging components are rotated. The components can be rotated simultaneously or sequentially, and additional components can be present in the printer but not rotated. Step 1009 is followed by step 1011.

In step 1011, while each rotated imaging component is rotating, measurements are taken of the respective distances at a plurality of angles of rotation of the imaging component as reference distances using the respective runout sensor. Not all rotating components need be measured. This is as described above with respect to step 942 (FIG. 9B). Step 1011 is followed by step 1020.

In step 1020, the measured reference distances or information identifying the reference distances are stored in a memory. The memory can be volatile or non-volatile, e.g., a RAM, ROM, HDD, Flash, or core. Distances are stored for each measured imaging component. Step 1020 is followed by step 1025 and produces distances 1022.

Distances 1022 are the stored reference distances or information identifying them. As described below, a characteristic frequency or phase of the distances can be determined and stored. Distances 1022 are provided to operation 1055 and to optional step 1045.

In step 1025, one or more images are produced using the print engine. These can be test images or normal print-job images, as described above with reference to step 920 (FIG. 9A). In various embodiments, images are produced until a user, operator, or service technician observes image artifacts in the printed images. In other embodiments, images are produced until a selected elapsed time or time of operation has elapsed, or until a selected number of images has been printed. Step 1025 is followed by step 1030.

In step 1030, the rotatable imaging components are rotated. The imaging components can be rotated simultaneously or sequentially, and not all imaging components in the printer are required to be rotated. Step 1030 is followed by step 1035.

In step 1035, while each rotatable imaging component is rotating, measurements are taken of the respective distances at a plurality of angles of rotation of the imaging component as test distances using the respective runout sensor. This can be done as discussed above with respect to FIG. 5. Measurements are taken as each angle of rotation passes through the angular position of the reference axis. Imaging components can be measured simultaneously or sequentially, and not all rotating components are required to be measured. Step 1035 produces distances 1037.

Distances 1037 are the stored test distances or information identifying them. As described below, a characteristic frequency or phase of the distances can be determined and stored. Distances 1037 are provided to operation 1055 and optional step 1050.

Operation 1055 automatically compares the reference distances for each imaging component from reference distances 1022 to the test distances for that imaging component from test distances 1037. This permits determining which imaging component(s) are malfunctioning: the imaging components whose distances do not match have changed performance between the reference measurements and test measurements, so are strong candidates for the cause of any image artifacts. In embodiments in which a human identifies the presence of an image artifact, the malfunctioning imaging component(s) are determined to be causing the image artifact. The imaging component(s) whose distances have changed are determined to be causes, individually or together, of artifacts. Since this method does not consider or require any measurement of density, it is unaffected by factors such as toner concentration that can affect density measurements. Operation 1055 produces determined malfunction 1060.

In an example, the RMS error between corresponding points in corresponding distance sets is calculated. Any error above a selected threshold indicates a change in performance.

Determined malfunction 1060 is which imaging component(s) are determined to be malfunctioning. Cause 1060 is provided to optional step 1070. In optional step 1070, the determined malfunction is reported to an operator using an interface, as described above.

As discussed above with reference to step 1020, in various embodiments, frequency spectra can be determined and stored. In other embodiments, frequency spectra can be determined from the stored distance. An example of the latter embodiments includes steps 1045 and 1050.

In step 1045, respective reference frequency spectra of the stored reference distances 1022 are computed as described above. Step 1045 produces spectra 1047. Spectra 1047 are respective frequency spectra of the measured reference distances 1022 for each component. Spectra 1047 are provided to operation 1055 in place of reference distances 1022 themselves.

In step 1050, respective frequency spectra of the measured test distances are computed as described above. Step 1050 produces spectra 1052. Spectra 1052 are respective frequency spectra of the measured test distances for each imaging component. Spectra 1052 are provided to operation 1055. In these embodiments, operation 1055 compares the spectra rather than the distances. Spectra can be compared as discussed above for operation 948 (FIG. 9B).

In various embodiments, the measured test distances can be evaluated as described above to determine if they are aperiodic. If so, any aperiodic imaging component can be identified as a determined malfunction 1060.

As discussed above with reference to FIGS. 6, 7, and 9A, image data can be adjusted in various ways to correct for consistent artifacts. Ways useful with various embodiments include those described in commonly assigned, co-pending U.S. patent application Ser. No. 12/577,233, filed Oct. 12, 2009, entitled "ADAPTIVE EXPOSURE PRINTING AND PRINTING SYSTEM," by Kuo et al., and commonly assigned, U.S. patent application Ser. No. 12/748,762, filed Mar. 29, 2010, entitled "SCREENED HARDCOPY REPRODUCTION APPARATUS COMPENSATION," by Tai, et al., the disclosures of which are incorporated herein by reference.

In an embodiment, the test image is formed (FIG. 9A step 925) with a test patch having a selected aim density. The amount of variation, whether intentional or unintentional, is the measured density minus the aim density, or the measured potential minus the potential corresponding to the aim density. The amount of variation is stored. To determine the correction value to adjust image data (FIG. 6 step 624), the variation amount corresponding to the measured distance is determined, retrieved from memory, or interpolated from one or more stored distances or variation amounts. To adjust the image data (FIG. 6 step 626), the correction value is subtracted from the image data of the region. In an example using correction values corresponding to angles of rotation (FIG. 7), the aim density is 2.0. The reproduced density at an angle of rotation of 150° is 2.1, so the amount of variation is +0.1. The reproduced density at 180° is 2.2, so the amount of variation is +0.2. The correction value v for 165°, halfway between the two readings, is determined by linear interpolation to be $$v=[(165°-150°)/(180°-150°)]\times(0.2-0.1)+0.1=0.15.$$

The image data for 165° is thus adjusted by subtracting 0.15. When the image data specifies a density of 1.5, the adjusted image data specifies a density of 1.35. Since the reproduced densities are higher than the aim densities, the printer will print the region at 165° close to a density of 1.5.

In various embodiments, the correction values can be subtracted from the image data (additive correction), or divided into the image data (multiplicative correction). For example, if the reproduced density at 165° is 2.5 for an aim of 2.0, the amount of variation can be determined to be 2.5/2.0=×1.25. The adjusted image data can therefore be 1.5/1.25=1.2.

In another embodiment, the test target includes two or more test patches formed at respective, different aim density levels, e.g., 1.0 and 2.0. The measurements at each point are combined by curve fitting as a function of aim density to produce a curve relating aim density to reproduced density. In an example, the reproduced density for an aim of 1.0 is 1.6, and an aim of 2.0 is reproduced as 2.2. The linear fit through these two points is $$\text{reproduced density}=(0.6\times\text{aim density})+1.0$$

so the inverse of that relationship, as used for adjusting image data, is $$\text{adjusted density}=(5/3\times\text{reproduced density})-5/3.$$

This inverse is used to determine the adjusted density to be supplied to the printer as adjusted image data for a desired reproduced density matching a desired aim density. To reproduce a density of 1.8 on the printer, for example, the image data would be adjusted to 4/3≈1.333. Linear, log, exponential, power, polynomial, or other fits can be used. The more points are used to make the fit, the more finely the actual variation can be represented, up to the amount of memory selected to be used for coefficients and measurements. As a result, adjusting the image data can include applying gains or offsets, taking powers, and other mathematical operations corresponding to the type of fit used.

In various embodiments, at least one test patch in the test target extends in the cross-track direction, and the measurement points are spread across the test patch. In other embodiments, multiple test patches arranged along the cross-track direction are used. In any of these embodiments, different amounts of variations are determined for different points along the cross-track axis. Image data adjustments are made using the fits or variation amounts for the corresponding, closest, or interpolated cross-track position.

In various embodiments, image-formation variables are adjusted rather than, or in addition to, image data. For example, the voltage of the toning shell or photoreceptor, the charger voltage, the maximum photoreceptor exposure, and the developer flow rate can be adjusted to compensate for variations. For example, for variation due to runout on a toning roller, the toning roller bias voltage can be varied in sync with the runout to provide higher electrostatic toning forces when the gap is larger, and lower forces when the gap is smaller.

Embodiments described above with first and second components can be applied to any number of imaging components.

Figure 11:
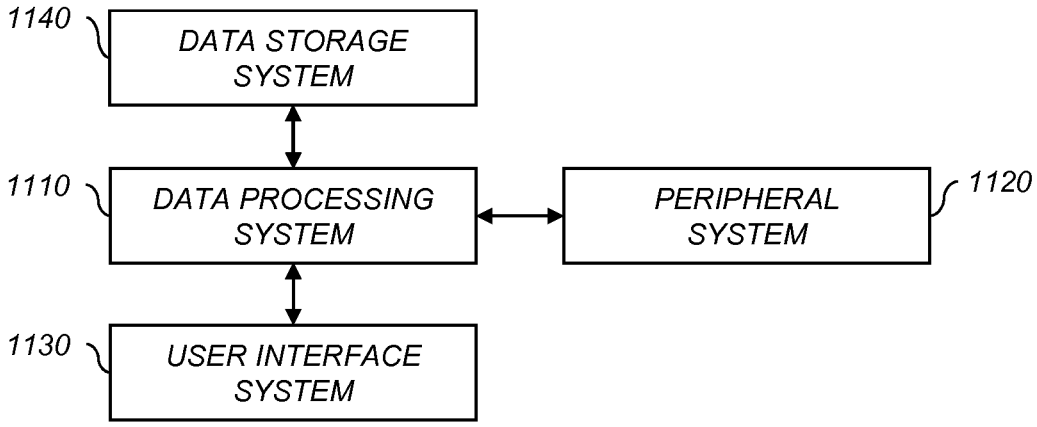
FIG. 11 is a high-level diagram showing the components of a data-processing system according to various embodiments.

FIG. 11 is a high-level diagram showing the components of a data-processing system for analyzing measurements and performing other analyses described herein according to various embodiments. The system includes a data processing system 1110, a peripheral system 1120, a user interface system 1130, and a data storage system 1140. The peripheral system 1120, the user interface system 1130 and the data storage system 1140 are communicatively connected to the data processing system 1110.

The data processing system 1110 includes one or more data processing devices that implement the processes of the various embodiments, including the example processes described herein. The phrases "data processing device" or "data processor" are intended to include any data processing device, such as a central processing unit ("CPU"), a desktop computer, a laptop computer, a mainframe computer, a personal digital assistant, a Blackberry™, a digital camera, cellular phone, or any other device for processing data, managing data, or handling data, whether implemented with electrical, magnetic, optical, biological components, or otherwise.

The data storage system 1140 includes one or more processor-accessible memories configured to store information, including the information needed to execute the processes of the various embodiments, including the example processes described herein. The data storage system 1140 can be a distributed processor-accessible memory system including multiple processor-accessible memories communicatively connected to the data processing system 1110 via a plurality of computers or devices. On the other hand, the data storage system 1140 need not be a distributed processor-accessible memory system and, consequently, can include one or more processor-accessible memories located within a single data processor or device.

The phrase "processor-accessible memory" is intended to include any processor-accessible data storage device, whether volatile or nonvolatile, electronic, magnetic, optical, or otherwise, including but not limited to, registers, floppy disks, hard disks, Compact Discs, DVDs, flash memories, ROMs, and RAMs.

The phrase "communicatively connected" is intended to include any type of connection, whether wired or wireless, between devices, data processors, or programs in which data can be communicated. The phrase "communicatively connected" is intended to include a connection between devices or programs within a single data processor, a connection between devices or programs located in different data processors, and a connection between devices not located in data processors. In this regard, although the data storage system 1140 is shown separately from the data processing system 1110, one skilled in the art will appreciate that the data storage system 1140 can be stored completely or partially within the data processing system 1110. Further in this regard, although the peripheral system 1120 and the user interface system 1130 are shown separately from the data processing system 1110, one skilled in the art will appreciate that one or both of such systems can be stored completely or partially within the data processing system 1110.

The peripheral system 1120 can include one or more devices configured to provide digital content records to the data processing system 1110. For example, the peripheral system 1120 can include digital still cameras, digital video cameras, cellular phones, or other data processors. The data processing system 1110, upon receipt of digital content records from a device in the peripheral system 1120, can store such digital content records in the data storage system 1140.

The user interface system 1130 can include a mouse, a keyboard, another computer, or any device or combination of devices from which data is input to the data processing system 1110. In this regard, although the peripheral system 1120 is shown separately from the user interface system 1130, the peripheral system 1120 can be included as part of the user interface system 1130.

The user interface system 1130 also can include a display device, a processor-accessible memory, or any device or combination of devices to which data is output by the data processing system 1110. In this regard, if the user interface system 1130 includes a processor-accessible memory, such memory can be part of the data storage system 1140 even though the user interface system 1130 and the data storage system 1140 are shown separately in FIG. 11.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

| | |
|---|---|
| 31, 32, 33, 34, 35 | printing module |
| 38 | print image |
| 39 | fused image |
| 40 | supply unit |
| 42, 42A, 42B | receiver |
| 50 | transfer subsystem |
| 60 | fuser |
| 62 | fusing roller |
| 64 | pressure roller |
| 66 | fusing nip |
| 68 | release fluid application substation |
| 69 | output tray |
| 70 | finisher |
| 81 | transport web |
| 86 | cleaning station |
| 99 | logic and control unit (LCU) |
| 100 | printer |
| 102, 103 | roller |
| 104 | transmission densitometer |
| 105 | power supply |
| 109 | interframe area |
| 110 | light beam |
| 111, 121, 131, 141, 151 | imaging component |
| 112, 122, 132, 142, 152 | transfer component |
| 113, 123, 133, 143, 153 | transfer backup component |
| 124, 125 | corona tack-down chargers |
| 201 | transfer nip |
| 202 | second transfer nip |
| 206 | photoreceptor |
| 210 | charging subsystem |
| 211 | meter |
| 212 | meter |
| 213 | grid |
| 216 | surface |
| 220 | exposure subsystem |
| 225 | development subsystem |
| 226 | toning shell |
| 227 | magnetic core |
| 240 | power source |
| 402, 403 | imaging component |

-continued

| | |
|---|---|
| 409 | runout axis |
| 410 | reference coordinate frame |
| 420 | component coordinate frame |
| 421 | index point |
| 425 | reference axis |
| 426 | reference point |
| 427 | distance |
| 428 | angle of rotation |
| 430 | component coordinate frame |
| 431 | index point |
| 435 | reference axis |
| 436 | reference point |
| 437 | distance |
| 438 | angle of rotation |
| 439 | tangent line |
| 440 | nip spacing |
| 520 | sensor |
| 521 | emitter |
| 522 | receiver |
| 523 | controller |
| 530 | sensor |
| 531 | emitter |
| 532 | receiver |
| 533 | controller |
| 610 | provide printer with first imaging component step |
| 615 | receive image signal step |
| 620 | rotate first component step |
| 622 | measure distance step |
| 624 | determine correction value step |
| 626 | adjust image data step |
| 628 | deposit toner on receiver step |
| 670 | provide printer with second imaging component step |
| 680 | rotate second component step |
| 682 | measure distance step |
| 684 | determine correction value step |
| 710 | provide printer with first imaging component step |
| 720 | rotate first component step |
| 722 | measure distances step |
| 724 | determine correction values step |
| 726 | store correction values step |
| 730 | receive image signal step |
| 731 | rotate first component step |
| 732 | determine angle of rotation of first component step |
| 734 | retrieve determined correction value(s) step |
| 736 | adjust image data step |
| 738 | deposit toner on receiver step |
| 770 | provide printer with second imaging component step |
| 780 | rotate second component step |
| 782 | measure distances step |
| 791 | rotate second component step |
| 792 | determine angle of rotation of second component step |
| 801 | print engine |
| 820 | sensor |
| 821 | emitter |
| 822 | receiver |
| 823 | controller |
| 825 | reference axis |
| 826 | reference point |
| 830 | toning zone |
| 850 | artifact sensor |
| 905 | provide ep printer step |
| 910 | produce reference image step |
| 912 | detect artifacts in reference image step |
| 914 | store artifact information step |
| 920 | produce images step |
| 925 | produce test image step |
| 927 | detect artifacts in test image step |
| 930 | artifact does not correspond? decision step |
| 935 | determine artifact spectrum step |
| 936 | artifact spectrum |
| 940 | rotate components step |
| 942 | measure component distances step |
| 944 | determine component spectra step |
| 946 | component spectra |

-continued

| | |
|---|---|
| 947 | filtering step |
| 948 | compare operation |
| 950 | determined cause |
| 960 | report cause step |
| 970 | periodic artifact? decision step |
| 975 | rotate components step |
| 980 | measure component distances step |
| 985 | identify aperiodicity in distances step |
| 1000 | provide EP printer step |
| 1009 | rotate components step |
| 1011 | measure reference distances step |
| 1020 | store reference distances step |
| 1022 | reference distances |
| 1025 | produce images step |
| 1030 | rotate components step |
| 1035 | measure test distances step |
| 1037 | test distances |
| 1045 | determine reference spectra step |
| 1047 | reference spectra |
| 1050 | determine test spectra step |
| 1052 | test spectra |
| 1055 | compare operation |
| 1060 | determined malfunction |
| 1070 | report malfunction step |
| 1110 | data processing system |
| 1120 | peripheral system |
| 1130 | user interface system |
| 1140 | data storage system |
| ITM1-ITM5 | intermediate transfer component |
| PC1-PC5 | imaging component |
| $R_n$-$R_{(n-6)}$ | receiver |
| S | slow-scan direction |
| TR1-TR5 | transfer backup component |

The invention claimed is:

1. A method of determining the cause of artifacts in images produced by an electrophotographic (EP) printer, comprising:

providing the EP printer with:

a print engine for producing an image on a receiving member, the print engine including a plurality of rotatable imaging components;

a plurality of runout sensors for measuring the distance between a respective reference point and the surface of the respective rotatable imaging component along a respective reference axis; and an artifact sensor for detecting one or more artifacts, or the absence of artifacts, in the produced image;

producing a reference image using the print engine, detecting zero or more artifact(s) in the reference image using the artifact sensor, and storing information identifying the detected artifact(s) in a memory;

producing one or more image(s) using the print engine;

producing a test image using the print engine and detecting zero or more artifact(s) in the test image using the artifact sensor;

determining whether at least one of the detected artifacts in the test image does not correspond to one of the zero or more artifact(s) detected in the reference image using the stored information;

if one of the artifact(s) does not correspond:

selecting one of the non-corresponding image artifact(s) in the test image;

determining a characteristic frequency spectrum of the selected image artifact;

rotating at least two of the rotatable imaging components and, while each rotatable imaging component is rotating, measuring the respective distances of the component at a plurality of angles of rotation of the imaging component using the respective runout sensor;

automatically determining a respective characteristic frequency spectrum of each measured imaging component using the corresponding measured distances; and automatically comparing the characteristic frequency spectrum of the selected image artifact in the test image to the respective characteristic frequency spectra of one or more of the measured imaging component(s) to determine which imaging component(s) are causing the image artifact.

2. The method according to claim 1, further comprising reporting the determined cause of the artifact to an operator using an interface.

3. The method according to claim 1, further comprising, if one of the artifact(s) in the test image does not correspond to one of the zero or more artifact(s) detected in the reference image:

automatically determining whether one or more of the non-corresponding image artifact(s) is periodic; and if a selected one of the artifact(s) is not periodic:

rotating the rotatable imaging components;

while each rotatable imaging component is rotating, measuring the respective distances at a plurality of angles of rotation of the imaging component using the respective runout sensor, the plurality of angles including angles in at least two revolutions of the imaging component; and automatically determining, using a processor, which of the imaging component(s) has measured distances that are aperiodic over the measured revolutions, so that that cause of the selected image artifact is identified to include the component(s) having such aperiodic distances.

4. The method according to claim 1, further comprising, for each characteristic frequency spectrum of one of the measured imaging components, selecting one or more frequencies of interest in the characteristic frequency spectrum and filtering the characteristic frequency spectrum of the selected image artifact in the test image with the selected frequencies of interest before comparing the spectrum of the artifact to the spectrum of the component.

5. A method of identifying malfunctions in an electrophotographic (EP) printer, comprising:

providing the EP printer with:

a print engine for producing an image on a receiving member, the print engine including a plurality of rotatable imaging components; and a plurality of runout sensors for measuring the distance between a respective reference point and the surface of the respective rotatable imaging component along a respective reference axis;

a first rotating step of rotating the rotatable imaging components and, while each rotated imaging component is rotating, measuring the respective distances at a plurality of angles of rotation of the imaging component as reference distances using the respective runout sensor;

for each measured imaging component, storing the measured reference distances or information identifying the reference distances in a memory;

producing one or more images using the print engine;

a second rotating step of rotating one or more of the rotatable imaging components and, while each rotated imaging component is rotating, measuring the respective distances at a plurality of angles of rotation of the imaging component as test distances using the respective runout sensor; and comparing the stored reference distances to the respective test distances and determining that a component whose test distances do not correspond to the respective reference distances is malfunctioning.

6. The method according to claim 5, further comprising reporting the determined cause of the fault to an operator using an interface.

7. The method according to claim 5, further including determining respective reference frequency spectra of the measured reference distances for each component; and determining respective test frequency spectra of the measured test distances for each component;

wherein the comparing step includes comparing the respective reference frequency spectra and test frequency spectra.

* * * * *